US005198332A

United States Patent [19]

Ikegawa et al.

[11] Patent Number: 5,198,332

[45] Date of Patent: * Mar. 30, 1993

[54] SILVER HALIDE PHOTOGRAPHIC EMULSION

[75] Inventors: Akihiko Ikegawa; Yuichi Ohashi; Masaki Okazaki, all of Minami-Ashigara, Japan

[73] Assignee: Fuji Photo film Co. Ltd., Japan

[ * ] Notice: The portion of the term of this patent subsequent to Dec. 26, 2006 has been disclaimed.

[21] Appl. No.: 512,603

[22] Filed: Apr. 23, 1990

Related U.S. Application Data

[63] Continuation of Ser. No. 124,061, Nov. 23, 1987, abandoned.

[30] Foreign Application Priority Data

Nov. 27, 1986 [JP] Japan ..... 61-282339
Jan. 7, 1987 [JP] Japan ..... 62-1458

[51] Int. Cl.[5] ..... G03C 1/18
[52] U.S. Cl. ..... 430/588; 430/585
[58] Field of Search ..... 430/585, 588

[56] References Cited

U.S. PATENT DOCUMENTS

| | | | |
|---|---|---|---|
| 2,521,705 | 9/1950 | Firestine | 430/588 |
| 2,521,959 | 9/1950 | Anish | 430/588 |
| 4,362,813 | 12/1982 | Mihara et al. | 430/550 |
| 4,705,744 | 11/1987 | Sasaki et al. | 430/505 |
| 4,889,796 | 12/1989 | Ikegawa et al. | 430/549 |
| 4,965,181 | 10/1990 | Kubodera et al. | 430/550 |
| 4,970,141 | 11/1990 | Ikegawa et al. | 430/550 |

FOREIGN PATENT DOCUMENTS 709873 8/1941 Fed. Rep. of Germany .

OTHER PUBLICATIONS

Sasaki et al., "Color Reproduction of Fujicolor Reala", Nihan Shashin Gakkai Shi, vol. 52, pp. 41–48 (1989).
Ctein, "Fuji Reala: A New Color Neg. Choice for Pros", Photomethods, pp. 17–19 (1989).

*Primary Examiner*—Charles L. Bowers, Jr.
*Assistant Examiner*—Janet C. Baxter

[57] ABSTRACT

A silver halide photographic emulsion which contains at least one of the compounds represented by the following general formula (I) each having a maximum value of spectral sensitivity in a wavelength of 520 nm or more and less than 545 nm, as a sensitizing dye.

wherein $R_0$ and $R_1$ may be the same or different, and represent hydrogen atoms, unsubstituted or substituted alkyl groups, unsubstituted or substituted aryl groups, unsubstituted or substituted alkoxy groups, unsubstituted or substituted aryloxy groups, halogen atoms, unsubstituted or substituted alkoxycarbonyl groups, unsubstituted or substituted acylamino groups, unsubstituted or substituted acyl groups, cyano groups, unsubstituted or substituted carbamoyl groups, unsubstituted or substituted sulfamoyl groups, carboxyl groups, or unsubstituted or substituted acyloxy groups, provided that $R_0$ and $R_1$ do not represent hydrogen atoms at the same time; $R_2$ represents a hydrogen atom, an unsubstituted or substituted alkyl group, or an unsubstituted or substituted aryl group; $R_3$ represents an unsubstituted or substituted alkyl group, an unsubstituted or substituted aryl group, an unsubstituted or substituted alkoxy group, an unsubstituted or substituted aryloxy group, an unsubstituted or substituted acyl group, an unsubstituted or substituted acyloxy group, an unsubstituted or substituted alkoxycarbonyl, or an unsubstituted or substituted acylamino group, and furthermore B is a substituent having such L and B that S value is 544 or less in the equation of $S=3.536L-2.661B+535.4$ wherein L represents a parameter of STERIMOL, and B represents the smaller value among $B_1+B_3$ which are parameters of STERIMOL, provided that $R_0$ and $R_3$, or $R_1$ and $R_3$ do not represent unsubstituted or substituted aryl groups at the same time; $R_4$ and $R_5$ may be the same or different and represent unsubstituted or substituted alkyl groups; X represents a counter anion; and n is 0 or 1, and when an inner salt is formed, n is 0.

Stability in preservation after application is improved.

18 Claims, No Drawings

SILVER HALIDE PHOTOGRAPHIC EMULSION

This application is a continuation of application Ser. No. 07/124,061, filed Nov. 23, 1987, now abandoned.

BACKGROUND OF THE INVENTION

2. Field of the Invention

This invention relates to a silver halide photographic emulsion, and particularly relates to a silver halide photographic emulsion having an elevated spectral sensitivity in a green color wavelength region. More specifically the present invention relates to a silver halide photographic emulsion which has a maximum value of spectral sensitivity at a wavelength of 520 nm or more and less than 545 nm, and leads to photographic light sensitive materials having excellent preservability and stability.

2. Description of the Prior Art

As sensitizing dyes having the maximum of spectral sensitivity at a wavelength of 520 nm or more and less than 545 nm, benzimidazolooxazolocarbocyanines (compounds disclosed, for example, in Japanese Patent Publication for Opposition Purpose (hereinafter referred to as "J.P. KOKOKU") No. 44-14030 and the like) and dimethinemerocyanines (compounds disclosed, for example, in U.S. Pat. Nos. 2,493,748, 2,519,001 and 3,480,439) have hitherto been known. As for emulsions containing a benzimidazolooxazolocarbocyanine or a dimethinemerocyanine, increase of fog after application of the emulsions under a high temperature or high temperature and high humidity condition, or lowering of sensitivity owing to poorness of stability with time lapse after application of the emulsions was observed. As sensitizing dyes free from these defects, namely increase of fog under a high temperature or high temperature and high humidity condition, or lowering of sensitivity with time lapse, benzoxazolocarbocyanines (compounds disclosed, for example, in French Patent Nos. 1,108,788, 2,182,329 and 3,514,450, West German Patent No. 2,429,228, and the like) have been known, but the maximum values of spectral sensitivity of benzoxazolocarbocyanines which have hitherto been used are usually in the region of 545 nm or more. Thus it has been very difficult to provide a silver halide photographic emulsion containing a sensitizing dye which has the maximum value of spectral sensitivity at a wavelength of 520 nm or more and less than 545 nm, and is excellent in preservability and stability.

SUMMARY OF THE INVENTION

The present invention relates to spectral sensitization of a silver halide photographic emulsion, and a first object of the present invention is to provide a silver halide photographic emulsion having an elevated spectral sensitivity in a green color wavelength region.

A second object of the present invention is to provide a silver halide photographic emulsion which has the maximum value of spectral sensitivity at a wavelength of 520 nm or more and less than 545 nm, and leads to photographic light-sensitive materials having excellent preservability and stability.

The above objects of the present invention have been accomplished by a silver halide photographic emulsion which contains at least one of the compounds represented by the following general formula:

General formula

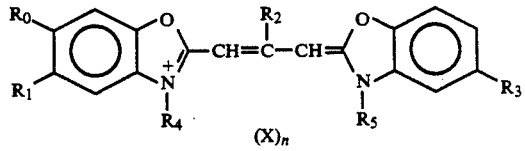

wherein $R_0$ and $R_1$ may be the same or different, and represents hydrogen atoms, alkyl groups (containing those having a substituent), aryl groups (containing those having a substituent), alkoxy groups (containing those having a substituent), aryloxy groups (containing those having a substituent), halogen atoms, alkoxycarbonyl groups (containing those having a substituent), acrylamino groups (containing those having a substituent), acyl groups (containing those having a substituent), cyano groups, carbamoyl groups (containing those having a substituent), sulfamoyl groups (containing those having a substituent), carboxyl groups, or acyloxy groups (containing those having a substituent), provided that $R_0$ and $R_1$ do not represent hydrogen atoms at the same time; $R_2$ represents a hydrogen atom, an alkyl group (containing one having a substituent), or an aryl (containing one having a substituent); $R_3$ represents an alkyl group having two or more carbon atoms, an aryl group, an alkoxy group having two or more carbon atoms, an aryloxy group, an acyl group having three or more carbon atoms, an acyloxy group having three or more carbon atoms, an alkoxycarbonyl group having four or more carbon atoms, or an acylamino group having three or more carbon atoms, and the alkyl group, the aryl group, the alkoxy group, the aryloxy group, the acyl group, the acyloxy group, the alkoxycarbonyl group and the acylamino group of $R_3$ may respectively have a substituent, and furthermore $R_3$ is required to be a substituent having such L and B that S value is 544 or less in the equation of $S=3.536L-2.661B+535.4$ wherein L represents "L" (its unit is A) as a STERIMOL parameter disclosed in A. Verloop, W. Hoogenstraaten, J. Tipker: "Drug Design, Vol VII" (E. J. Arië ns Ed.) Academic Press, New York (1976), pp. 180–185 and the like, and B represents the smaller value among $B_1+B_4$ and $B_2+B_3$ which are parameters of STERIMOL (their units are Å), provided that $R_0$ and $R_3$, or $R_1$ and $R_3$ do not represent aryl groups at the same time; $R_4$ and $R_5$ may be the same or different and represent substituted or unsubstituted alkyl groups; X represents a counter anion; and n is 0 or 1, and when an inner salt is formed, n is 0.

DETAILED DESCRIPTION OF THE INVENTION

Preferred examples of each substituent in the compounds represented by the general formula (I) as used in the present invention are demonstrated below. Preferred $R_0$ and $R_1$ groups are alkyl groups having 10 or less carbon atoms such as methyl groups, ethyl groups, propyl groups, isopropyl groups, n-butyl groups, branched butyl groups (e.g., isobutyl groups, t-butyl groups and the like), n-pentyl groups, branched pentyl groups (e.g., isopentyl groups, t-pentyl groups and the like), vinylmethyl groups, and cyclohexyl groups; aryl groups having 10 or less carbon atoms such as phenyl groups, 4-methylphenyl groups, 4-chlorophenyl groups and naphthyl groups; aralkyl groups having 10 or less carbon atoms such as benzyl groups, phenethyl groups and 3-phenylpropyl groups; alkoxy groups having 10 or less carbon atoms such as methoxy groups, ethoxy groups, propyloxy groups, butyloxy groups, pentyloxy groups, benzyloxy groups and phenethyloxy groups; aryloxy groups having 10 or less carbon atoms such as phenoxy groups, 4-methylphenoxy groups, 4-chlorophenoxy groups and naphthyloxy groups; halogen atoms, i.e., fluorine atoms, chlorine atoms, bromine atoms and iodine atoms; haloalkyl groups such as trifluoromethyl groups; alkoxycarbonyl groups having 10 or less carbon atoms such as methoxycarbonyl groups, ethoxycarbonyl groups and benzyloxycarbonyl groups; acylamino groups having 8 or less carbon atoms such as acetylamino groups, propionylamino and benzoylamino groups; acyl groups having 10 or less carbon atoms such as acetyl groups, propionyl groups, benzoyl groups and mesyl groups; cyano groups; carbamoyl groups having 6 or less carbon atoms such as carbamoyl groups, N,N-dimethylcarbamoyl groups and morpholinocarbonyl groups; sulfamoyl groups having 6 or less carbon atoms such as sulfamoyl groups, N,N-dimethylsulfamoyl groups, morpholinosulfamoyl groups and piperidinosulfonyl groups; carboxyl groups; and acyloxy groups having 10 or less carbon atoms such as acetyloxy groups, propionyloxy groups and benzoyloxy groups. Most preferred compounds are those having a hydrogen atom as $R_0$ and a phenyl group as $R_1$.

Preferred examples of the $R_2$ group include a hydrogen atom; an alkyl group having 4 or less carbon atoms such as a methyl group, an ethyl group, a propyl group and a butyl group; an aryl group having 10 or less carbon atoms such as a phenyl group and a p-tolyl group; and an aralkyl group having 10 or less carbon atoms such as a benzyl group, a phenethyl groups and a 3-phenylpropyl group.

Preferred examples of the $R_3$ group include an alkyl group, an aryl group, an aralkyl group, a haloalkyl group, an alkoxy group, an aryloxy group, an acyl group, an acyloxy group, an alkoxycarbonyl group and an acylamino group.

Under the condition that $R_3$ is a substituent having such L and B that S value is 544 or less in the equation of $S = 3.536L - 2.661B + 535.4$, preferred substituents of $R_3$ include an alkyl group having two or more carbon atoms, an alkoxy group having two or more carbon atoms, an acyl group having three or more carbon atoms, an acyloxy group having three or more carbon atoms, an alkoxycarbonyl group having 4 or more carbon atoms, and an. acylamino group having three or more carbon atoms. Preferably, $R_3$ has 12 or less carbon atoms.

Most preferred examples of the $R_3$ group include an ethyl group, a propyl group, an isopropyl group, a t-butyl group, an isopentyl group, a t-pentyl group, a 3,3-dimethylbutyl group, a cyclohexyl group, a t-octyl group, a benzyl group, a phenethyl group and a t-butylcarbonyloxy group.

As $R_4$ and $R_5$ groups, alkyl groups having 8 or less carbon atoms such as methyl groups, ethyl groups, propyl groups, vinylmethyl groups, butyl groups, pentyl groups, hexyl groups, beptyl groups or octyl groups; or aralkyl groups having 10 or less carbon atoms such as benzyl groups, phenethyl groups or 3-phenylpropyl groups may be mentioned. As a substituent on each of $R_4$ and $R_5$, a hydroxyl group; a carboxyl group; a sulfo group; a cyano group; a halogen atom such as a fluorine atom, a chlorine atom or a bromine atom; an alkoxycarbonyl group having 8 or less carbon atoms such as a methoxycarbonyl group, an ethoxycarbonyl group or a benzyloxycarbonyl group; an alkoxy group having 8 or less carbon atoms such as a methoxy group, an ethoxy group, a butyloxy group, a benzyloxy group or a phenethyloxy group; an aryloxy group having 8 or less carbon atoms such as a phenoxy group or a p-tolyloxy group; an acyloxy group having 8 or less carbon atoms such as an acetyloxy group, a propionyloxy group or a benzoyloxy group; an acyl group having 8 or less carbon atoms such as an acetyl group, a propionyl group, a benzoyl group or a 4-fluorobenzoyl group; a carbamoyl group having 6 or less carbon atoms such as a carbamoyl group, an N,N-dimethylcarbamoyl group, a morpholinocarbonyl group or a piperidinocarbonyl group; a sulfamoyl group having 6 or less carbon atoms such as a sulfamoyl group, an N,N-dimethylsulfamoyl group, a morpholinosulfonyl group or a piperidionosulfonyl group; an aryl group having 10 or less carbon atoms such as a phenyl group, a p-fluorophenyl group, a p-hydroxyphenyl group, a p-carboxyphenyl group or a p-sulfophenyl group may be mentioned.

Examples of a counter anion X include p-toluenesulfonate, halide such as bromide, chloride, iodide p-nitrobenzenesulfonate, methanesulfonate, methylsulfate, ethylsulfate, 1,5-naphthalene disulfonate, perchlorate, and the like.

Typical examples of compounds of the above general formula (I) to be used in the present invention are demonstrated below, but the scope of the present invention should not be interpreted to be limited only to these compounds.

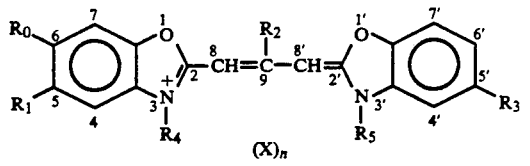

| Compound No. | $R_0$ | $R_1$ | $R_2$ | $R_3$ | $R_4$ | $R_5$ | X | n |
|---|---|---|---|---|---|---|---|---|
| 1 | H | 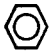 | H | $(CH_2)_2CH_3$ | $(CH_2)_4$ $\vert$ $SO_3^-$ | $(CH_2)_4$ $\vert$ $SO_3H.N(C_2H_5)_3$ | — | 0 |
| 2 | H | 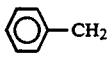 | $CH_3$ | $C_2H_5$ | $(CH_2)_4$ $\vert$ $SO_3^-$ | $C_2H_5$ | — | 0 |

-continued

| Compound No. | $R_0$ | $R_1$ | $R_2$ | $R_3$ | $R_4$ | $R_5$ | X | n |
|---|---|---|---|---|---|---|---|---|
| 3 | H | 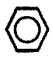 | $C_2H_5$ | $CH_3$<br>\|<br>$C-CH_3$<br>\|<br>$CH_3$ | $(CH_2)_2$<br>\|<br>$SO_3^-$ | $(CH_2)_4$<br>\|<br>$SO_3H$ | — | 0 |
| 4 | H | 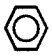 | $CH_3$ | $CH_3$<br>\|<br>$C-C_2H_5$<br>\|<br>$CH_3$ | $(CH_2)_2$<br>\|<br>$SO_3^-$ | $(CH_2)_4$<br>\|<br>$SO_3Na$ | — | 0 |
| 5 | H | $CH_3$<br>\|<br>$C_2H_5-C$<br>\|<br>$CH_3$ | $C_2H_5$ | $CH_3$<br>\|<br>$C-CH_3$<br>\|<br>$CH_3$ | $(CH_2)_3$<br>\|<br>$SO_3^-$ | $(CH_2)_3$<br>\|<br>$SO_3K$ | — | 0 |
| 6 | H | 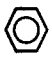 | $C_2H_5$ | 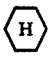 | $(CH_2)_2$<br>\|<br>$SO_3^-$ | $(CH_2)_3$<br>\|<br>$SO_3H.N(C_2H_5)_3$ | — | 0 |
| 7 | H | 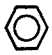 | $C_2H_5$ | $CH_3$<br>\|<br>$C-C_2H_5$<br>\|<br>$CH_3$ | $(CH_2)_2$<br>\|<br>$SO_3^-$ | $(CH_2)_4$<br>\|<br>$SO_3Na$ | — | 0 |
| 8 | H | Cl | $CH_3$ | 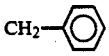 | $(CH_2)_3$<br>\|<br>$SO_3^-$ | $(CH_2)_3$<br>\|<br>$SO_3H.N(C_2H_5)_3$ | — | 0 |
| 9 | H | $CH_3$ | $C_2H_5$ | 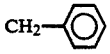 | $C_2H_5$ | $C_2H_5$ | 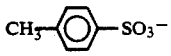 | 1 |
| 10 | H | $(CH_3)_2NSO_2$ | $(CH_2)_2CH_3$ | $CH(CH_3)_2$ | $C_2H_5$ | $(CH_2)_3$<br>\|<br>$SO_3^-$ | — | 0 |
| 11 | 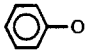 | H | $C_2H_5$ | $CH_3$<br>\|<br>$C-CH_3$<br>\|<br>$CH_3$ | $(CH_2)_4$<br>\|<br>$SO_3^-$ | $(CH_2)_4$<br>\|<br>$SO_3H.N(C_2H_5)_3$ | — | 0 |
| 12 | $CH_3(CH_2)_4O$ | H | 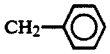 | 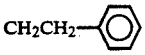 | $(CH_2)_4$<br>\|<br>$SO_3^-$ | $(CH_2)_2$<br>\|<br>$SO_3Na$ | — | 0 |
| 13 | HOOC | H | $C_2H_5$ | $CH_3$<br>\|<br>$OCOC-CH_3$<br>\|<br>$CH_3$ | $(CH_2)_3$<br>\|<br>$SO_3^-$ | $C_2H_5$ | — | 0 |
| 14 | $CH_3$<br>>NCO<br>$CH_3$ | H | H | $CH_3$<br>\|<br>$CH_2CH_2-C-CH_3$<br>\|<br>$CH_3$ | $(CH_2)_4$<br>\|<br>$SO_3^-$ | $CH_3$ | — | 0 |
| 15 | H | 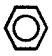 | $C_2H_5$ | $CH_3$<br>\|<br>$C-C_2H_5$<br>\|<br>$CH_3$ | $C_2H_5$ | $C_2H_5$ | $Br^-$ | 1 |
| 16 | $CH_3O$· | H | $CH_3$ | 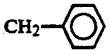 | $CH_3$ | $(CH_2)_3$<br>\|<br>$SO_3^-$ | — | 0 |
| 17 | Cl | H | H | 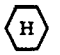 | $(CH_2)_3$<br>\|<br>$SO_3^-$ | $(CH_2)_4$<br>\|<br>$SO_3K$ | — | 0 |
| 18 | H | 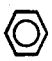 | $C_2H_5$ | $CH_3$ $CH_3$<br>\|\|<br>$C-CH_2-C-CH_3$<br>\|\|<br>$CH_3$ $CH_3$ | $(CH_2)_2$<br>\|<br>$SO_3^-$ | $(CH_2)_4$<br>\|<br>$SO_3Na$ | — | 0 |

-continued

| Compound No. | $R_0$ | $R_1$ | $R_2$ | $R_3$ | $R_4$ | $R_5$ | X | n |
|---|---|---|---|---|---|---|---|---|
| 19 | H | 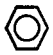 | $C_2H_5$ | $CH_2$— 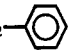 | $(CH_2)_2$ \| $SO_3^-$ | $(CH_2)_4$ \| $SO_3H$ | — | 0 |
| 20 | $CH_3$ | $CH_3$ | $C_2H_5$ | $CH_3$ \| C—$C_2H_5$ \| $CH_3$ | $(CH_2)_3$ \| $SO_3^-$ | $(CH_2)_3$ \| $SO_3Na$ | — | 0 |

With respect to group $R_3$ and the aforementioned STERIMOL parameters, the "L" parameter represents the length of group $R_3$ along the axis of the bond between the group $R_3$ and the benzene nucleus to which the group $R_3$ is connected. The "B" parameters, i.e., $B_1$, $B_2$, $B_3$ and $B_4$ each represent the width of the group $R_3$ which are measured at the maximum points and perpendicular to the axis and each other, provided that $B_1$ is the smallest value and $B_2$, $B_3$ and $B_4$ are successively larger. L, $B_1$, $B_2$, $B_3$ and $B_4$ represent Sterimol parameters in terms of Å including consideration of standard bond angles, van der Waals radic, bond lengths, and conformations of the group $R_3$ in space.

L and S values of various $R_3$ substituents and S values calculated from the equation of $S=3.536L-2.661B+535.4$ are shown in the following table.

| Substituent $R_3$ | L(Å) | B(Å) | S |
|---|---|---|---|
| $-C_2H_5$ | 4.11 | 3.80 | 540 |
| $-C_3H_7^{(n)}$ | 5.05 | 3.80 | 543 |
| $-C_3H_7^{(i)}$ | 4.11 | 5.20 | 536 |
| $-C_4H_9^{(t)}$ | 4.11 | 5.56 | 535 |
| $-C_5H_{11}^{(t)}$ | 5.05 | 5.72 | 538 |
| $-C_2H_4C(CH_3)_3$ | 6.17 | 5.56 | 542 |
| $-CH_2C_6H_5$ | 3.63 | 6.22 | 533 |
| $-C_6H_{11}^{(cyclo)}$ | 6.17 | 5.53 | 543 |
| $-C_2H_4C_6H_5$ | 4.63 | 6.22 | 535 |
| $-OCOC(CH_3)_3$ | 5.96 | 5.56 | 542 |
| $-C_8H_{17}^{(t)}$ | 6.00 | 5.72 | 541 |
| $-C_6H_5$ | 6.28 | 3.40 | 549 |

Compounds of the present invention represented by the above general formula (I) can readily be synthesized according to methods disclosed, for example in F.M. Hamer, "Heterocyclic Compounds—The Cyanine Dyes and Related Compounds" John Wiley & Sons (1964).

A sensitizing dye used in the present invention can directly be dispersed in an emulsion. Alternatively, it can first be dissolved in a suitable solvent, for example methyl alcohol, ethyl alcohol, methyl cellosolve, acetone, water or pyridine or a mixed solvent thereof, and then added to an emulsion as a solution. Ultrasonic wave can be used to dissolve it. As a method for addition of this sensitizing dye, a method as disclosed in U.S. Pat. No. 3,469,987 or the like wherein a dye is dissolved in a volatile organic solvent, the solution is dispersed in a hydrophilic colloid, and the dispersion is added to an emulsion; a method as disclosed in J.P. KOKOKU No. 46-24185 or the like wherein a water insoluble dye is dispersed in a water soluble solvent without dissolving it, and this dispersion is added to an emulsion; a method as disclosed in U.S. Pat. No. 3,822,135 or the like wherein a dye is dissolved in a surfactant and the solution is added to an emulsion; a method as disclosed in Japanese Patent Unexamined Published Application (hereinafter referred to as "J.P. KOKAI") No. 51-74624 wherein a dye is dissolved using a compound capable of red shift, and the solution is added to an emulsion; a method as disclosed in J.P. KOKAI No. 50-80826 wherein a dye is dissolved an acid substantially free from water, and the solution is added to an emulsion; or the like may be used. Furthermore, a method for addition to an emulsion disclosed in U.S. Pat. No. 2,912,343, 3,342,605, 2,996,287 or 3,429,835, or the like may also be used. Further, the above sensitizing dye may uniformly be dispersed in a silver halide emulsion before it is applied on a suitable support, and may of course be dispersed in any step for preparation of a silver halide emulsion.

That is, the sensitizing dye may be added in any step of preparation of a photographic emulsion, or in any stage from after preparation of the emulsion to just before application thereof. Examples of the former stage are a silver halide grain-forming step, a physical ripening step, a chemical ripening step and the like A sensitizing dye of the present invention may be used in an amount sufficient for effectively increasing sensitivity of an emulsion This amount may widely be changed according to the condition of an emulsion to be used, but may preferably be used in an amount of $1\times10^{-6}$ to $5\times10^{-3}$ mole, preferably $3\times10^{-6}$ to $2.5\times10^{-3}$ mole per mole of the silver halide Any silver halide among silver bromide, silver bromoiodide, silver bromochloroiodide, silver bromochloride and silver chloride may be used in the photographic emulsion of the present invention Silver halide grains in the photographic emulsion may be so-called regular grains which have a regular crystal shape such as cubic, octahedron or fourteenhedron, grains having an irregular crystal shape such as sphere, or grains having crystal defect such as crystal surface, or grains having a composite shape thereof Grain size of the silver halide may be a fine size of 0.1 micron or less, or a large size up to 10 microns in diameter of projected area. Further, an emulsion containing such silver halide may be a monodispersed emulsion having a narrow distribution, or a multi-dispersed emulsion having a wide distribution.

A silver halide photographic emulsion of the present invention can be prepared according to a known method, for example a method disclosed in Research Disclosure, No. 17643 (December, 1978), pages 22 to 23 ("I. Emulsion preparation and types"), or ibid. No. 18716 (November, 1976), page 648.

A photographic emulsion of the present invention can also be prepared using a method disclosed in P. Glafkides, Chimie et Physique Photographique, Paul Montel, 1967; G.F. Duffin, Photographic Emulsion Chemistry, Focal Press, 1966; V.L. Zelikman et al., Making and Coating Photographic Emulsion, Focal Press, 1964, or the like. That is, any of an acidic method, a neutral method, an ammoniacal method and the like may be utilized, and as for a method for reacting a soluble silver salt with a soluble halogen salt, any of a single-jet method, a double-jet method and a combination thereof may be utilized. Further, a method wherein grains are formed using excess silver ions (a so-called reverse-jet method) can also be utilized. Further, a method wherein pAg in a liquid phase where a silver halide is formed is held constant, namely a so-called controlled double-jet method can also be used. According to this method, a silver halide emulsion containing grains having a regular crystal shape and an almost uniform size may be obtained.

Further, it is also possible to mix two or more kinds of silver halide emulsions which have been separately prepared.

A silver halide emulsion comprising the aforementioned regular grains may be obtained by controlling pAg and pH during formation of grains, as is detailedly described, for example in Photographic Science and Engineering, vol. 6, pages 159 to 165 (1962); Journal of Photographic Science, vol. 12, pages 242 to 251 (1964); U.S. Pat. No. 3,655,394 or U.K. Patent No. 1,413,748.

Typical monodispersed emulsion is such an emulsion that contains silver halide grains which have an average grain diameter more than about 0.1 micron and at least 95 weight % of which have grain diameter which fall within ±40% of the average grain diameter. An emulsion which contains silver halide grains which have an average grain diameter of 0.25 to 2 micron, and at least 95 weight % or at least 95% in number of which fall within ±20% of the average grain diameter can also be used in the present invention. Processes for preparation of such an emulsion are disclosed in U.S. Pat. Nos. 3,574,628 and 3,655,394 and U.K. Patent No. 1,413,748. Monodispersed emulsions disclosed in J.P. KOKAI Nos. 48-8600, 51-39027, 51-83097, 53-137133, 54-48521, 54-99419, 58-37635, 58-49938 and the like can also preferably be used in the present invention.

Further, tabular grains having an aspect ratio of 5 or more can also be used in the present invention. Tabular grains can readily be prepared according to a method disclosed in U.S. Pat. Nos. 4,434,226, 4,414,310, 4,433,048 or 4,439,520, U.K. Patent No. 2,112,157, or the like. When tabular grains are used, various advantages such as enhancement of spectral sensitization efficiency by a sensitizing dye, enhancement of graininess and increase of sharpness are brought about, which is detailedly described in U.S. Pat. No. 4,434,226 referred to above.

Among tabular grains having an aspect ratio of 5 or more, those having an aspect ratio of 5 to 100 are preferred, and those having an aspect ratio of 5 to 20 are particularly preferred. Diameter corresponding to a circle of tabular grains is preferably 0.2 to 30 microns, particularly preferably 0.4 to 10 microns. Further, thickness of tabular grains is preferably 0.5 micron or less, particularly preferably 0.3 micron or less.

Crystals of silver halide may be composed of a homogeneous structure, a heterogeneous structure having halogen composition different in inner and outer portions, or a layer structure. Such various emulsion grains are disclosed in U.K. Patent No. 1,027,146, U.S. Pat. Nos. 3,505,068 and 4,444,877, J.P. KOKAI No. 60-143331, and the like. Particularly preferred grains and those substantially having two distinct layer structures (core/shell structure) composed of core part of a higher iodine content and shell part of a lower iodine content. These grains are further described below.

Distinct layer structure hereinbefore mentioned can be judged from X-ray diffraction. Examples wherein an X-ray diffraction method is applied to silver halide grains are demonstrated in H. Hirsh, Journal of Photographic Science, volume 10 (1962), pages from 129, and the like. When grating constant is determined by the halogen composition, peak of diffraction is formed at a diffraction angle satisfying the condition of Black (2 dsin $=n\theta$).

Methods for measuring X-ray diffraction are detailedly disclosed in Kiso Bunseki Kagaku Koza (Fundamental analytical chemistry lectures) No. 24 "X-ray analysis" (Kyoritsu Shuppan Co., Ltd.), "X-sen Kaisetsu no Tebiki" (Guidance to X-ray diffraction) (Rigaku Denki Co., Ltd.), and the like. A standard measuring method is a method wherein diffraction curve of the (220) faces of silver halides is determined using Cu as a target and K $\beta$-rays of Cu as a ray source (tube voltage of 40 kV, tube current of 60 mA). In order to enhance the resolving power of a measuring apparatus, it is necessary to ascertain measurement accuracy appropriately selecting the width of slit (divergent slit, rays-catching slit or the like), time constant of an apparatus, scanning rate of a goniometer, and recording speed, and using a standard sample such as a silicon.

When emulsion grains have two distinct layer structures, two peaks composed of diffraction maximum owing to silver halide in the higher iodine layer and diffraction maximum owing to silver halide in the lower iodine layer are formed on the diffraction curve.

Substantially two distinct layer structures means structures where in a curve of diffraction intensity to diffraction angle about the (220) face of silver halide as obtained by using K$\beta$-rays of Cu in a diffraction angle (2 $\theta$) range of 38 to 42°, two diffraction maximums composed of a diffraction peak corresponding to a higher iodine layer containing 10 to 45 mole % silver iodide and a diffraction peak corresponding to a lower iodine layer containing 5 mole % or less silver iodide, and one diffraction minimum between them are formed, and a diffraction intensity of peak corresponding to the higher iodine layer is 1/10 to 3/1 based on a diffraction intensity of peak corresponding to the lower iodine layer. In the above description, further preferred ratio of diffraction intensities is 1/5 to 3/1, particularly 1/3 to 3/1.

As an emulsion having substantially two distinct layer structures, preferred is one wherein the diffraction intensity of minimum between the two peaks is 90% or less of the diffraction intensity weaker among those of two diffraction maximums (peaks). The above ratio is further preferably 80% or less, particularly preferably 60% or less. Methods for analyzing a diffraction curve composed of two diffraction components are well known and described, for example in Jikken Butsurigaku Koza 11, Koshi Kekkan (Experimental Physiolosy Lectures No. 11, Lattice Defect) (Kyoritsu Shuppan Co., Ltd.), and the like.

EPMA method (Electron-Probe Micro Analyzer method) may also be used besides X-ray diffraction method in order to determine whether a silver halide emulsion is an emulsion having two distinct layer structures or an emulsion wherein two kinds of silver halide grains coexist.

In this method, a sample wherein emulsion grains are well dispersed so as not to come in contact with one another is prepared, and irradiated with electron beam. Elementary analysis of extremely minute parts can be carried out according to X-ray analysis under electron beam excitation.

Halogen composition of each grain can be determined by measuring intensities of characteristic X-rays of silver and iodine emitted from each grain.

It can be judged by ascertaining the halogen compositions of at least 50 grains according to EPMA method whether the emulsion is an emulsion containing grains having layer structure or not.

It is preferable that iodine contents among grains having a layer structure are as uniform as possible. More specifically, it is preferable that relative standard deviation in distribution of iodine content among grains measured according to EPMA method is 50% or less, further 35% or less, particularly 20% or less.

Preferred halogen composition of a silver halide grain having distinct layer structure is as follows.

Core part thereof is composed of silver halide of a higher iodine content, and the iodine content is preferably from 10 mole % to 45 mole % which is the upper limit for forming a solid solution. The above iodine content is further preferably 15 to 45 mole %, particularly 20 to 45 mole %.

Either silver chlorobromide or silver bromide may be used as silver halide other than silver iodide in the core part, but a higher rate of silver bromide is preferable.

Outside layer of the grain is composed of silver halide containing 5 mole % or less, preferably 2 mole % or less silver iodide. Either silver chloride, silver chlorobromide or silver bromide may be used as silver halide other than silver iodide in the outside layer, but a higher rate of silver bromide is preferable.

Though the emulsion having a distinct layer structure may have a wide grain size distribution, an emulsion having a narrow grain size distribution is preferred. Particularly in case of regular crystal grains, it is preferable to use a monodispersed emulsion which contains silver halide grains, at least 90% by weight or at least 90% in number of which respectively have grain sizes which fall within ±40%, particularly ±30% of the average grain size.

An emulsion having a distinct layer structure can be prepared according to a properly combined process among various methods known in the field of silver halide photographic light-sensitive materials.

In order to obtain excellent photographic performances using an emulsion comprising silver halide grains each having a distinct layer structure, it is necessary that the higher iodine silver halide of the core is adequately coated with the lower iodine silver halide of the shell. Shell thickness to be adopted is varied depending on grain size, and preferably 0.1 micron or more in a large-sized grain of 1.0 micron or more, and 0.05 micron or more in a small-sized grain less than 1.0 micron. In order to obtain an emulsion having a distinct layer structure, it is preferable that the silver amount ratio of the core part to the shell part falls within a range of 1/5 to 5, further preferably 1/5 to 3, particularly 1/5 to 2.

As previously described, the phrase "a silver halide grain substantially has two distinct layer structures" means that two regions having different halogen compositions substantially exist in the grain, and an explanation was made defining the center side as core part and the surface side as shell part.

The phrase "substantially two" means that the third region other than the core part and the shell part, for example a layer existing between the core part of the center and the shell part of the most outside layer may sometimes exist.

However, even though such third region exists, it should exist in such a limited range that the shapes of two peaks, namely two peaks corresponding to a higher iodine part and a lower iodine part in the above-described X-ray diffraction pattern are not substantially affected.

That is, a silver halide grain wherein a core part of a higher iodine content, an intermediate part, and a shell part of a lower iodine content exist; two peaks and one minimum part between the two peaks exist in X-ray diffraction pattern; the ratio of diffraction intensity corresponding to the higher iodine part to that corresponding to the lower iodine part is 1/10 to 3/1, preferably 1/5 to 3/1, particularly preferably 1/3 to 3/1; and diffraction intensity of the minimum part is 90% or less, preferably 80% or less, particularly 70% or less of the diffraction intensity weaker among those of two diffraction maximums, is a grain substantially having two distinct layer structures.

The above viewpoint is similarly applied when a third region exists inside the core.

Further, silver halides mutually having different compositions may be conjugated by epitaxial conjunction, and a silver halide may be conjugated with a compound other than silver halide such as silver rhodanide or lead oxide by epitaxial conjunction. These emulsion grains are disclosed in U.S. Pat. Nos. 4,094,684, 4,142,900 and 4,459,353, U.K. Patent No. 2,038,792, U.S. Pat. Nos. 4,349,622, 4,395,478, 4,433,501, 4,463,087, 3,656,962 and 3,852,067, J.P. KOKAI No. 59-162540, and the like.

Further, it is possible to use a mixture of grains of various crystal shapes.

An emulsion of the present invention is usually subjected to physical ripening and chemical ripening prior to use. Additives to be used in such steps are disclosed in Research Disclosure Nos. 17643 and 18716, and the relevent parts are summarized in the following table.

Known photographic additives usable in the present invention are also disclosed in the above two Research Disclosure journals, and the relevant parts are summarized in the following table.

| | Kind of additive | RD 17643 | RD 18716 |
|---|---|---|---|
| 1 | Chemically sensitizing agent | page 23 | page 648, right column (r.c.) |
| 2 | Sensitivity-enhancing agent | | page 648, right column (r.c.) |
| 3 | Spectrally sensitizing agent | pages 23–24 | page 648 r.c. –page 649 r.c. |
| 4 | Antifoggant and fog-stabilizing agent | pages 24–25 | page 649 r.c. |
| 5 | Light-absorbing agent, Filter dye and UV absorbent | pages 25–26 | page 649 r.c. –page 650 r.c. |
| 6 | Stain inhibitor | page 25 r.c. | pages 650 left column (l.c.)–r.c. |
| 7 | Hardening agent | page 26 | page 651 l.c. |
| 8 | Binder | page 26 | " |
| 9 | Plasticizer and lubricant | page 27 | page 650 r.c. |
| 10 | Coating aid and surfactant | pages 26–27 | " |

-continued

| | Kind of additive | RD 17643 | RD 18716 |
|---|---|---|---|
| 11 | Static inhibitor | page 27 | " |

Various color-forming couplers can be used in the present invention, and specific examples thereof are disclosed in patents listed in the above Research Disclosure (RD) No. 17643, VII-C G. As dye-forming couplers, couplers which respectively give three primary colors (i.e., yellow, magenta and cyan) in subtractive color process by color development are important. Examples of nondiffusible 4- or 2-equivalent couplers preferably used in the present invention include couplers disclosed in patents disclosed in the aforementioned RD No. 17643, VII-C and D items as well as couplers described below.

Typical yellow dye-forming couplers usable in the present invention include hydrophobic acylacetoamide type couplers having a ballast group. Specific examples thereof are disclosed in U.S. Pat. Nos. 2,407,210, 2,875,057 and 3,265,506, and the like. 2-Equivalent yellow dye-forming couplers are preferably used in the present invention, and typical examples thereof include oxygen atom-coupling off type yellow dye-forming couplers disclosed in U.S. Pat. Nos. 3,408,194, 3,447,928, 3,993,501 and 4,022,620, and the like, and nitrogen atom-coupling off type yellow dye-forming couplers disclosed in J.P. KOKOKU No. 58-10739, U.S. Pat. Nos. 4,401,752 and 4,326,024, RD No. 18053 (April, 1979), U.K. Patent No. 1,425,020, German Patent APPLICATION (OLS) Nos. 2,219,917, 2,261,361, 2,329,587 and 2,433,812, and the like. α-Pivaloylacetanilide type couplers are excellent in fastness, particularly light fastness of their colored dyes, and on the other hand α-benzoylacetanilide type couplers give high color densities.

Magenta dye-forming couplers usable in the present invention include indazolone type, cyanoacetyl type, 5-pyrazolone type and pyrazoloazole type couplers which respectively have a ballast group and are hydrophobic, and 5-pyrazolone type and pyrazoloazole type couplers are preferable. As 5-pyrazolone type couplers, couplers whose 3-positions are respectively substituted with an arylamino group or an acylamino group are preferable in view of the hue or color density of their colored dyes, typical examples thereof are disclosed in U.S. Pat. Nos. 2,311,082, 2,343,703, 2,600,788, 2,908,573, 3,062,653, 3,152,896 and 3,936,015, and the like. As a coupling-off group of a 2-equivalent 5-pyrazolone type coupler, a nitrogen atom-coupling off group disclosed in U.S. Pat. No. 4,310,619, or an arylthio group disclosed in U.S. Pat. No. 4,351,897 is particularly preferred. A 5-pyrazolone type coupler having a ballast group as disclosed in European Patent No. 73,636 gives a high color density. As pyrazoloazole type couplers, pyrazolobenzimidazoles disclosed in U.S. Pat. No. 3,369,879, pyrazolo(5,1-C)(1,2,4)triazoles disclosed in U.S. Pat. No. 3,725,067, pyrazolotetrazoles disclosed in Research Disclosure No. 24,220 (June, 1984) and J.P. KOKAI No. 60-33552, and pyrazolopyrazoles disclosed in Research Disclosure No. 24,230 (June, 1984) and J.P. KOKAI No. 60-43659 may preferably be used. In view of reduced yellow subabsorption of a colored dye and light fastness of the colored dye, imidazo(1,2-b)pyrazoles disclosed in U.S. Pat. No. 4,500,630 are preferable, and pyrazole(1,5-b)(1,2,4)triazole disclosed in European Patent No. 119,860A is particularly preferable.

Cyan dye-forming couplers usable in the present invention include naphthol type and phenol type couplers which are hydrophobic and nondiffusible. Typical naphthol type couplers include naphthol type couplers disclosed in U.S. Pat. No. 2,474,293, and preferably oxygen atom-coupling off type 2-equivalent naphthol type couplers disclosed in U.S. Pat. Nos. 4,052,212, 4,146,396, 4,228,233 and 4,296,200. Specific examples of phenol type couplers are disclosed in U.S. Pat. Nos. 2,369,929, 2,801,171, 2,772,162 and 2,895,826, and the like. Cyan dye-forming couplers fast against humidity and temperature are preferably used in the present invention, and typical examples thereof include phenol type cyan dye-forming couplers having an alkyl group of an ethyl group and up at the meta position of the phenol nucleus as disclosed in U.S. Pat. No. 3,772,002; 2,5-diacylamino-substituted phenol type couplers disclosed in U.S. Pat. Nos. 2,772,162, 3,758,308, 4,126,396, 4,334,011 and 4,327,173, OLS No. 3,326,729, European Patent No. 121,365, and the like; phenol type couplers having a phenylureido group at the 2-position and an acylamino group at the 5-position as disclosed in U.S. Pat. Nos. 3,446,622, 4,333,999, 4,451,559 and 4,427,767, and the like; and the like.

In order to correct unnecessary absorption of a colored dye, it is preferable in color light-sensitive materials that masking is carried out by using a colored coupler together. Typical examples of the colored couplers include yellow-colored magenta dye-forming couplers disclosed in U.S. Pat. No. 4,163,670, J.P. KOKOKU No. 57-39413 and the like; magenta-colored cyan dye-forming couplers disclosed in U.S. Pat. Nos. 4,004,929 and 4,138,253, U.K. Patent No. 1,146,368, and the like; and the like. Other colored couplers are disclosed in the aforementioned RD No. 17643, Items VII -G.

It is possible to improve graininess by using such a coupler that a colored dye derived therefrom has a proper diffusibility.

As such couplers, specific examples of magenta dye-forming couplers are disclosed in U.S. Pat. No. 4,366,237 and U.K. Patent No. 2,125,570, and specific examples of yellow, magenta or cyan dye-forming couplers are disclosed in European Patent No. 96,570 and OLS No. 3,234,533.

Dye-forming couplers and the above special couplers may respectively form oligomers or polymers comprising two or more coupler unit.

Typical examples of polymerized dye-forming couplers are disclosed in U.S. Pat. Nos. 3,451,820 and 4,080,211. Specific examples of polymerized magenta dye-forming couplers are disclosed in U.K. Patent No. 2,102,173 and U.S. Pat. No. 4,367,282.

Couplers releasing a photographically useful residue upon coupling can also preferably be used in the form of polymer. As DIR couplers releasihg a development inhibitor, those disclosed in patents disclosed in the aforementioned RD No. 17643, item VII - F are useful.

Preferred DIR couplers to be used in combination with the present invention include developing solution-inactivating type DIR couplers typically disclosed in J.P. KOKAI No. 57-151944; timing type DIR couplers typically disclosed in U.S. Pat. No. 4,248,962 and J.P. KOKAI No. 57-154234; and reaction type DIR couplers typically disclosed in J.P. KOKAI No. 57-184248. Particularly preferred DIR couplers include developing solution-inactivating type DIR couplers disclosed in J.P. KOKAI Nos. 57-151944, 58-217932, 60-218644, 60-225156 and 60-233650, and the like, and reaction type DIR couplers disclosed in J.P. KOKAI No. 60-184248 and the like.

Suitable supports usable for photographic light-sensitive materials having a photographic emulsion of the present invention are disclosed, for example in the aforementioned RD No. 17643, page 28 and RD No. 18716, page 647 right-hand column to page 648 left-hand column.

Photographic light-sensitive materials to which a photographic emulsion of the present invention is applicable include various color and black-and-white light-sensitive materials. Examples os such light-sensitive materials include color negative films for photographing (for generic use, movie and the like), reversal color films (for slide, movie and the like; couplers are either included or not included), color photographic papers, color positive films (for movie and the like), reversal color photographic papers, color light-sensitive materials for thermal development, color light-sensitive materials by use of a silver dye bleaching method, photographic light-sensitive materials for making printing plates (litho-film, scanner film and the like), X-ray photographic light-sensitive materials (for direct or indirect medical use, industrial use, and the like), black-and-white negative films for photographing, black-and-white photographic papers, light-sensitive materials for micro-use (for COM, microfilm and the like, color diffusion transfer light-sensitive materials (DTR), silver salt diffusion transfer light-sensitive materials, print-out light-sensitive materials, and the like.

Exposure to light for obtaining a photographic image by a photographic light-sensitive material using a photographic emulsion of the present invention may be carried out using an usual method. That is, any of various known light sources containing infrared light such as natural light (sunlight), a tungsten lamp, a fluorescent lamp, a mercury lamp, a xenon arc lamp, a carbon arc lamp, a xenon flash lamp, cathode ray tube flying spot, luminescent diode, laser light (e.g., gas laser, YAG laser, dye laser, semiconductor laser and the like), and the like. Exposure to light may also be carried out by light emitted from a fluorescent material excited with electron beams, X-rays, $\gamma$-rays, $\alpha$-rays or the like. Exposure time may be 1/1000 to one second used in an ordinal camera, may also be a time shorter than 1/1000 second, for example $1/10^4$ to $1/10^6$ second in case of using a xenon flash lamp or a cathode ray tube, and may further be a time longer than one second. It is possible, according to necessity, to adjust spectral composition of light used in exposure using a color filter.

A photographic light-sensitive material to which a photographic emulsion of the present invention is applicable can be developed according to a usual method disclosed in the aforementioned RD No. 17643, pages 28 to 29, or RD No. 18716, page 651 left-hand column to right-hand column.

Examples of the present invention are demonstrated below, but the present invention should not be interpreted as limited only to these examples.

EXAMPLE 1

Silver halide grains are formed by a double-jet method, successively followed by physical ripening process, desalting process and chemical ripening process to obtain a silver iodobromide (containing 7.5 mole % iodine) emulsion. The average diameter of silver halide grains contained in this emulsion was 0.8 micron. Further, 0.55 mole of silver halide was contained in 1 kg of this emulsion.

One kilogram of the emulsion was placed in a pot and dissolved with heating to 40° C. Each of methanol solutions of sensitizing dyes listed in Table 1 was added thereto in a rate of $4.7\times10^{-4}$ mole of each dye per one mole of Ag, and the mixture was stirred. Then, 10 ml of an aqueous 1.0 weight % 4-hydroxy-6-methyl-1,3,3*a*,7-tetrazaindene solution, 10 ml of an aqueous 1.0 weight % 1-hydroxy-3,5-dichlorotriazine sodium salt solution, and 10 ml of an aqueous 1.0 weight % sodium dodecylbenzenesulfonate solution were successively added thereto, followed by stirring. This complete emulsion was applied onto a cellulose triacetate film base to a dried film thickness of 5 microns, and dried to obtain samples 101 to 110.

Each of these film samples was subjected to wedge exposure using a sensitometer having a light source of color temperature of 4800° K., which was accompanied with a yellow filter (SC-50 manufactured by Fuji Photo Film Co., Ltd.)

After exposure to light, each of the film samples was developed at 20° C. for 7 minutes using a developing solution having the following composition, subjected successively to stop and fixing processes, and then washed with water to obtain a strip having a black-and-white image This strip was subjected to density measurement using a P type densitometer manufactured by Fuji Photo Film Co., Ltd. to obtain sensitivity and fog. Reference point of optical density for determination of sensitivity was point of (fog +0.20). Composition of the developing solution

| | |
|---|---|
| Water | 700 ml |
| Metol | 2.0 g |
| Anhydrous sodium sulfite | 100.0 g |
| Hydroquinone | 5.0 g |
| Borax pentahydrate | 1.5 g |
| Water to | 1 l |

Results are shown in Table 1 using the fog value and sensitivity value of sample 101 of fresh performance (i.e., immediately after preparation of the sample), respectively as a standard Further, samples 101 to 110 were, after preservation for 3 days at 50° C. and 30% RH, similarly exposed to light and developed, and fog and sensitivity were determined. The results are shown in Table 1.

The peak wavelength of spectral sensitivity distribution of each photographic element was also measured and is shown in Table 1.

Sensitizing dyes used in comparative examples are as follows.

Sensitizing dye S-D
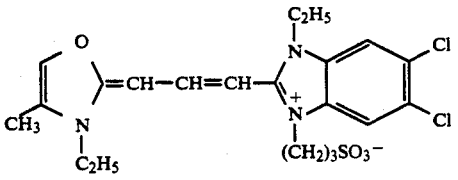
Sensitizing dye S-E
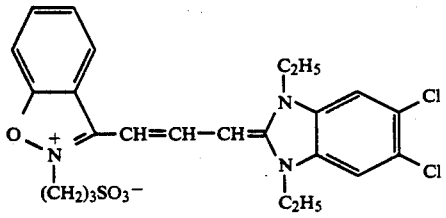
Sensitizing dye S-F
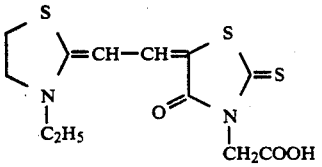
Sensitizing dye S-G
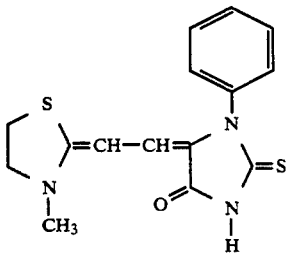
Sensitizing dye S-H
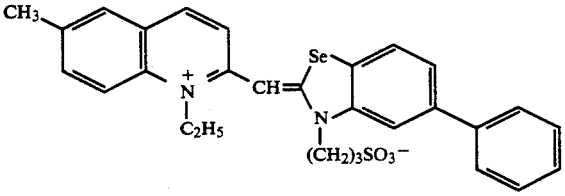
Sensitizing dye S-I
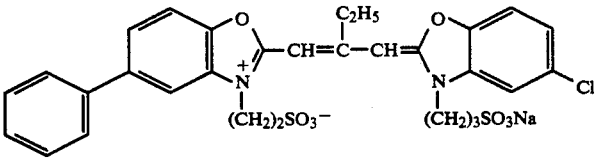
Sensitizing dye S-J
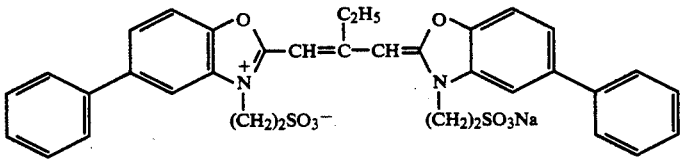
Sensitizing dye S-K
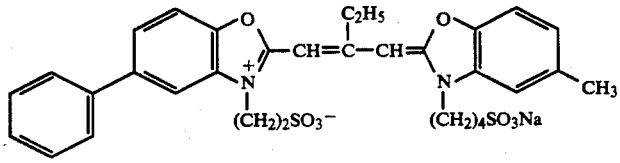

TABLE 1

| Sample No. | Sensitizing dye* | Spectral sensitivity peak wave-length (nm) | Fresh performance | | After preservation for 3 days (50° C., 30% RH) | |
|---|---|---|---|---|---|---|
| | | | Fog | Relative sensitivity | Fog | Relative sensitivity |
| 101 (Present invention) | Compound 7 | 535 | ±0 (standard of fog) | 100 (standard of sensitivity | +0.02 | 97 |
| 102 (Present invention) | Compound 19 | 533 | ±0.01 | 98 | +0.04 | 95 |
| 103 (Present invention) | Compound 5 | 529 | −0.01 | 96 | +0 | 93 |
| 104 (Comparative example) | S-D | 525 | +0.20 | 102 | +0.37 | 85 |
| 105 (Comparative example) | S-E | 533 | +0.08 | 89 | +0.14 | 68 |
| 106 (Comparative example) | S-F | 531 | +0.28 | 93 | +0.43 | 61 |
| 107 (Comparative example) | S-G | 525 | +0.09 | 89 | +0.12 | 66 |
| 108 (Comparative example) | S-H | 537 | +0.05 | 87 | +0.11 | 60 |
| 109 (Comparative example) | S-I | 556 | +0.01 | 117 | +0.03 | 112 |
| 110 (Comparative example) | S-J | 559 | ±0 | 122 | +0.01 | 118 |

*Sensitizing dye $4.7 \times 10^{-4}$ mole/mole Ag

EXAMPLE 2

A silver halide emulsion layer and a gelatin protective layer each having the following compositions were applied on a cellulose triacetate film support which had been provided with an undercoat, to prepare samples 201 to 210.

Light-Sensitive Layer Composition

Numeral corresponding to each component means a coated amount represented by a unit of $g/m^2$, and means a coated amount in terms of silver amount for silver halide. However, as for each of the sensitizing dyes, numeral corresponding thereto means a coated amount represented by mole per mole of the silver halide in the same layer.

| | |
|---|---|
| Emulsion layer | |
| Silver iodobromide emulsion | 2.0 |
| Silver iodide 6 mole %, Variation coefficient (S/F) of grain size = 0.18, Aspect ratio 6.0, Average grain size (F) = 0.8 micron | |
| Gelatin | 1.0 |
| Sensitizing dye (disclosed in Table 2) | $5.0 \times 10^{-4}$ |
| Cpd-5 | 0.25 |
| Cpd-15 | 0.25 |
| Cpd-8 | 0.03 |
| Cpd-7 | 0.05 |
| oil-1 | 0.50 |
| oil-4 | 0.13 |
| Protective layer | |
| Gelatin | 0.50 |
| Hardening agent H-1 | 0.40 |

Cpd-5

-continued

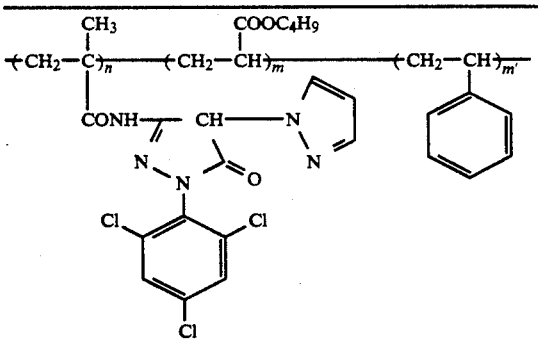

n = 50
m = 25
m' = 25
mol. wt. about 20,000

Cpd-7

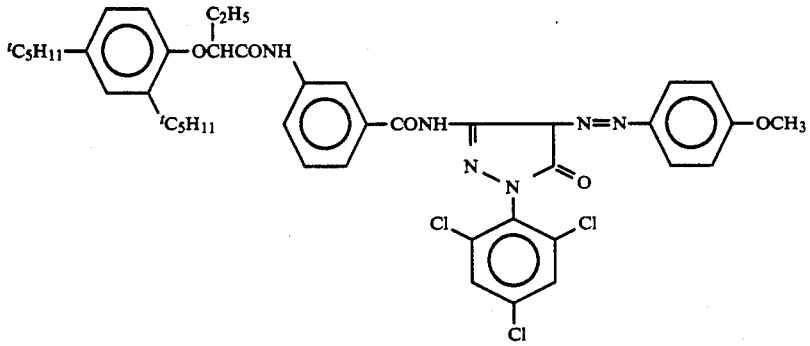

Cpd-8

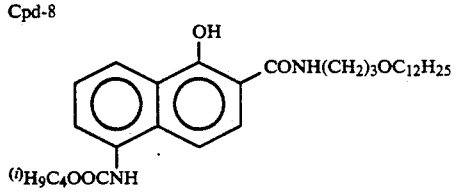

Cpd-15

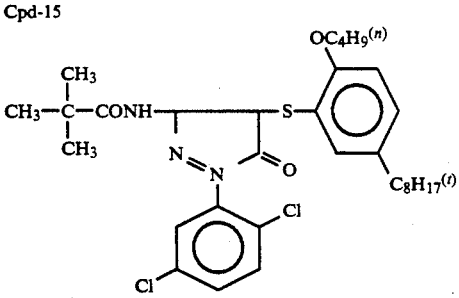

oil-1
tricresyl phosphate oil-4

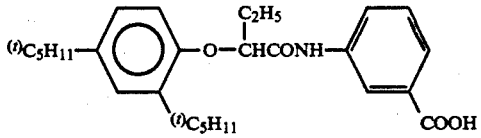

Hardening agent H-1

$CH_2{=}CHSO_2CH_2CONHCH_2$
$CH_2{=}CHSO_2CH_2CONHCH_2$

Each of the resulting photographic elements was preserved for 3 days at 50° C. and 80% RH, and then exposed to light with an exposure amount of 10 CMS using a tungsten light source whose color temperature had been changed to 4800° K. with a filter, and SC-50, an optical filter for measuring spectral sensitization speed manufactured by Fuji Photo Film Co., Ltd. Then, each element was subjected to the following developing process. The resulting results are shown in Table 2 together with each fresh performance.

Peak wavelength of spectral sensitivity distribution of each photographic element was also measured at the same time. Results are also shown in Table 2.

| | |
|---|---|
| Color development | 2 minutes 45 seconds |
| Bleaching | 6 minutes 30 seconds |
| Water washing | 2 minutes 10 seconds |
| Fixing | 4 minutes 20 seconds |
| Water washing | 3 minutes 15 seconds |
| Stabilization | 1 minute 5 seconds |

Composition of processing solutions used in the respective steps are as follows.

| | |
|---|---|
| Color developing solution | |
| Diethylenetriaminetetraacetic acid | 1.0 g |
| 1-Hydroxyethylidene-1,1-diphosphonic acid | 2.0 g |
| Sodium sulfite | 4.0 g |
| Potassium carbonate | 30.0 g |
| Potassium bromide | 1.4 g |
| Potassium iodide | 1.3 mg |
| Hydroxylamine sulfate | 2.4 g |
| 4-(N-Ethyl-N-β-hydroxyethylamino) -2-methylaniline sulfate | 4.5 g |
| Water to | 1.0 l |
| | pH 10.0 |
| Bleaching solution | |
| Ferric ammonium ethylenediaminetetraacetate | 100.0 g |
| Disodium ethylenediaminetetraacetate | 10.0 g |
| Ammonium bromide | 150.0 g |
| Ammonium nitrate | 10.0 g |

-continued

| | |
|---|---|
| Water to | 1.0 l |
| | pH 6.0 |
| Fixing solution | |
| Disodium ethylenediaminetetraacetate | 1.0 g |
| Sodium sulfite | 4.0 g |
| An aqueous ammonium thiosulfate solution (70%) | 175.0 ml |
| Sodium bisulfite | 4.6 g |
| Water to | 1.0 l |
| | pH 6.6 |
| Stabilizing solution | |
| Formalin (40%) | 2.0 ml |
| Polyethylene-p-monononylphenyl ether (average polymerization degree 10) | 0.3 g |
| Water to | 1.0 l |

TABLE 2

| Sample No. | Sensitizing dye* | Spectral sensitivity peak wave-length (nm) | Fresh performance Fog | Fresh performance Relative sensitivity | After preservation for 3 days at 50° C. under 80% RH Fog | After preservation for 3 days at 50° C. under 80% RH Relative sensitivity |
|---|---|---|---|---|---|---|
| 201 (Present invention) | Compound 7 | 534 | ±0 (standard of fog) | 100 (standard of sensitivity) | +0.03 | 96 |
| 202 (Present invention) | Compound 19 | 533 | ±0.01 | 97 | +0.05 | 94 |
| 203 (Present invention) | Compound 5 | 528 | −0.02 | 95 | ±0 | 92 |
| 204 (Comparative example) | S-D | 521 | +0.25 | 103 | +0.41 | 86 |
| 205 (Comparative example) | S-E | 530 | +0.10 | 87 | +0.17 | 70 |
| 206 (Comparative example) | S-F | 531 | +0.32 | 93 | +0.49 | 60 |
| 207 (Comparative example) | S-G | 523 | +0.10 | 87 | +0.16 | 68 |
| 208 (Comparative example) | S-H | 536 | +0.07 | 86 | +0.12 | 62 |
| 209 (Comparative example) | S-I | 550 | +0.02 | 115 | +0.04 | 109 |
| 210 (Comparative example) | S-J | 555 | −0.01 | 120 | +0.02 | 111 |
| 211 (Comparative example) | S-K | 534 | ±0 | 83 | +0.03 | 69 |

*Sensitizing dye $4.7 \times 10^{-4}$ mole/mole Ag

EXAMPLE 3

An solution of 30 g of inactive gelatin and 6 g of potassium bromide in 1 μ of distilled water was stirred at 60° C. Then, whole amount of a solution of 5.0 g of silver nitrate in 35 cc of water, and whole amount of a solution of 3.2 g of potassium bromide and 0.98 g of potassium iodide in 35 cc of water were added thereto respectively at a rate of 70 cc/minute for 30 seconds, ripened for 30 minutes at an elevated pAg of 10 to prepare a seed emulsion.

A predetermined amount of 1 μ of water containing 145 g of silver nitrate dissolved therein, and an aqueous solution of a mixture of potassium bromide and potassium iodide were added to the seed emulsion with equimolar amount portions with each other at a predetermined temperature at a predetermined pAg at an addition rate near the critical growth rate to prepare a tabular core emulsion. Then, the residual aqueous silver nitrate solution, and an aqueous solution of a mixture of potassium bromide and potassium iodide having a composition different from that in preparation of the core emulsion were thereto with equimolar amount portions at an addition rate near the critical growth rate to coat the core, whereby an emulsion containing core/shell type tabular silver iodobromide grains was prepared.

Emulsions prepared according to the above procedure are shown in Table 3. Evaluation tests similar to those in Example 2 were carried out using these emulsions, and results exhibiting similar effects were obtained.

TABLE 3

| Emulsion | Average iodine content | Aspect ratio | Grain size (Diameter corresponding to sphere) | Core/shell ratio (volume ratio) | Core/shell iodine content |
|---|---|---|---|---|---|
| A | 3.0 | 7.2 | 0.76 | 1/1 | 6/0 |
| B | 6.0 | 6.5 | 0.69 | 1/1 | 12/0 |
| C | 9.0 | 8.1 | 0.77 | 1/1 | 18/0 |
| D | 12.0 | 7.5 | 0.79 | 1/1 | 24/0 |
| E | 6.0 | 2.5 | 0.82 | 1/1 | 12/0 |
| F | 6.0 | 4.8 | 0.85 | 1/1 | 12/0 |
| G | 6.0 | 15.3 | 0.80 | 1/1 | 12/0 |
| H | 6.0 | 6.7 | 0.71 | Uniform | 6/6 |
| I | 6.0 | 6.8 | 0.73 | 1/1 | 0/12 |
| J | 6.0 | 6.6 | 0.80 | 1/2 | 18/0 |
| K | 1.5 | 8.0 | 0.75 | Uniform | 1.5/1.5 |
| L | 1.5 | 7.4 | 0.69 | 1/1 | 3/0 |

EXAMPLE 4

Evaluation tests similar to those in Example 2 were carried out using a monodispersed silver halide emulsion prepared according to the method disclosed in Example 1 of J.P. KOKAI No. 54-48521, and results exhibiting similar effects were obtained.

EXAMPLE 5

Evaluation tests similar to those in Example 2 were carried out using a multi-structural silver halide emulsion prepared according to the method disclosed in Example 1 of J.P. KOKAI No. 61-245151, and results exhibiting similar effects were obtained.

EXAMPLE 6

A spectrally sensitizing dye shown in Table 4 was added to a silver chlorobromide emulsion (silver chloride content 30 mol%) comprising monodispersed cubic grains having the average grain size of 0.4 micron in an amount of 250 mg per mole of silver halide. Then, chemical sensitization was carried out by addition of sodium thiosulfate in an amount of $2.0\times10^{-5}$ mole per mole of the silver halide. Further, 4-hydroxy-6-methyl-(1,3,3a,7)-tetraazaindene was added as a stabilizer in an amount of 300 mg per mole of the silver halide.

Separately, 100 g of magenta dye-forming coupler *a, 30 g of fading inhibitor *b, and 20 g of fading inhibitor *c were dissolved in a mixed solvent of 90 ml of solvent *d, 60 ml of solvent *e and 150 ml of ethyl acetate. This solution was emulsified and dispersed into 1200 g of an aqueous 10% gelatin solution containing 4.0 g of sodium dodecylbenzenesulfonate to prepare emulsified dispersion-1. Separately, 100 g of magenta coupler *f and 50 g of fading inhibitor *b were dissolved in a mixed solvent of 200 ml of solvent *d and 100 ml of ethyl acetate. This solution was emulsified and dispersed into 2000 g of an aqueous 10% gelatin solution containing 8.0 g of sodium dodecylbenzenesulfonate to prepare emulsified dispersion-2. Structures of compounds *a to *f are as follows.

(*a) Magenta dye-forming coupler

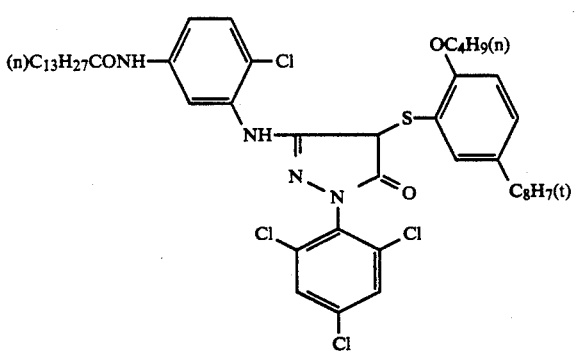

(*b) Fading inhibitor

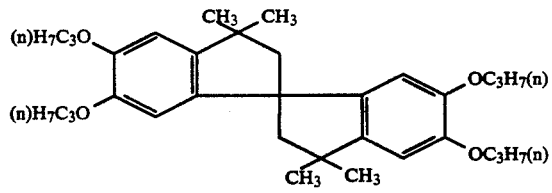

(*c) Fading inhibitor

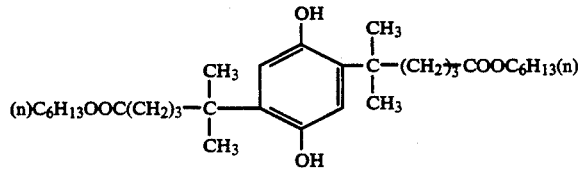

-continued $(C_8H_{17}O)_3-P=O$ (*d) Solvent

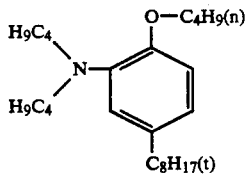

(*e) Solvent

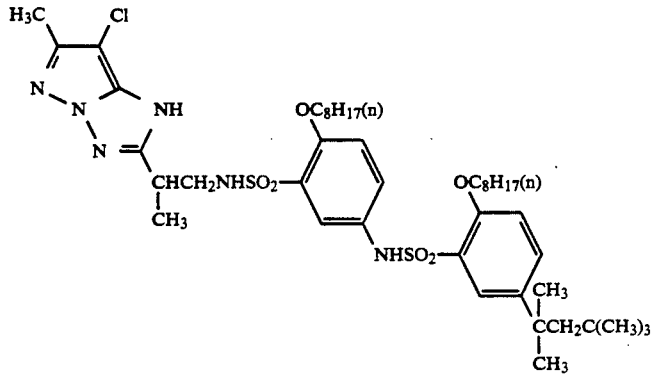

(*f) Magenta dye-forming coupler

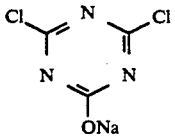

(*g) Hardening agent

A coating solution was prepared using the emulsion and emulsified dispersions 1 and 2, and applied together with a protective layer onto a paper whose both surfaces had been laminated with polyethylene, to prepare 16 kinds of samples in all each having content as shown in Tables 4 and 5. The polyethylene of the side which was coated with the emulsion layer and the protective layer contains titanium dioxide and a slight amount of ultramarine.

In order to ascertain preservability of these coated samples, changes of photographic performances after preservation for 4 weeks at 50° C. and 45% RH as a forced test were investigated. Samples before and after preservation were subjected to gradation exposure to light for sensitometry with an enlargement machine (FUJI COLOR HEAD 690, manufactured by FUJI PHOTO FILM CO., LTD.) through a green filter, and then subjected to developing process comprising the following process steps.

| Process steps | Temperature | Time |
|---|---|---|
| Developing | 33° C. | 3.5 minutes |
| Bleach-fixing | 33° C. | 1.5 minutes |
| Water washing | 28-35° C. | 3.0 minutes |

| Developing solution | |
|---|---|
| Diethylenetriaminepentaacetic acid | 1.0 g |
| Benzyl alcohol | 15 ml |
| Diethylene glycol | 10 ml |
| $Na_2SO_3$ | 2.0 g |
| KBr | 0.5 g |
| Hydroxylamine sulfate | 3.0 g |
| 4-Amino-3-methyl-N-ethyl-N-[β-(methanesulfonamido)ethyl]-p-phenylenediamine sulfate | 5.0 g |
| $Na_2CO_3$ (*monohydrate*) | 30 g |
| Water to | 1 l (pH 10.1) |

-continued

| Bleach-fixing solution | |
|---|---|
| Ammonium thiosulfate (54 wt %) | 150 ml |
| $Na_2SO_3$ | 15 g |
| $NH_4[Fe(EDTA)]$ | 55 g |
| EDTA2.2Na | 4 g |
| Water to | 1 l (pH 6.9) |

Color density of each sample after the above processing was measured, and sensitivity change of the sample after preservation based on before preservation and fog density of each sample were determined. The results ar shown in Table 5.

TABLE 4

| Sample No. | Support | Emulsified dispersion | Note |
|---|---|---|---|
| 301 | | Emulsified dispersion 1 | Present invention |
| 302 | | Magenta dye-forming coupler (*a) 300 mg/m² | Present invention |
| 303 | | Fading inhibitor (*b/*c) | Present invention |
| 304 | | 90/60 mg/m² | Comparative example |
| 305 | | Coupler solvent (*d/*e) | Comparative example |
| 306 | Paper support | 0.45 ml/m² | Comparative example |
| 307 | whose both surfaces | (Gelatin was added to the coating solution so | Comparative example |
| 308 | had been laminated | that coated gelatin amount is 1300 mg/m²) | Comparative example |
| 309 | with polyethylene | Emulsified dispersion 2 | Present invention |
| 310 | | Magenta dye-forming coupler (*f) 600 mg/m² | Present invention |

TABLE 4-continued

| Sample No. | Support | Emulsified dispersion | Note |
|---|---|---|---|
| 311 | | Fading inhibitor (*b) | Present invention |
| 312 | | 300 mg/m$^2$ | Comparative example |
| 313 | | Coupler solvent (*d) | Comparative example |
| 314 | | 1.20 ml/m$^2$ | Comparative example |
| 315 | | (Gelatin was added to the coating solution so that coated gelatin amount is 1800 mg/m$^2$) | Comparative example |
| 316 | | | |
| Coated amount in terms of silver amount 200 mg/m$^2$ Hardening agent (*g) 280 mg/m$^2$ | | Protective layer Coated gelatin amount 1500 mg/m$^2$ | |

TABLE 5

| Sample No. | Sensitizing dye | Before preservation Fog | Before preservation Relative sensitivity | After preservation Fog | After preservation Relative sensitivity |
|---|---|---|---|---|---|
| 301 (Present invention) | Compound 7 | ±0 (Standard of fog | 100 (Standard of sensitivity | +0.01 | 94 |
| 302 (Present invention) | Compound 19 | +0.01 | 98 | +0.02 | 95 |
| 303 (Present invention) | Compound 5 | −0.01 | 94 | +0.01 | 91 |
| 304 (Comparative example) | S-D | +0.18 | 102 | +0.31 | 89 |
| 305 (Comparative example) | S-E | +0.06 | 89 | +0.18 | 75 |
| 306 (Comparative example) | S-F | +0.22 | 92 | +0.36 | 64 |
| 307 (Comparative example) | S-G | +0.08 | 85 | +0.19 | 71 |
| 308 (Comparative example) | S-H | +0.05 | 83 | +0.10 | 65 |
| 309 (Present invention) | Compound 7 | +0.01 | 100 | +0.02 | 95 |
| 310 (Present invention) | Compound 19 | +0.02 | 99 | +0.03 | 95 |
| 311 (Present invention) | Compound 5 | 0.00 | 96 | +0.02 | 92 |
| 312 (Comparative example) | S-D | +0.17 | 103 | +0.35 | 91 |
| 313 (Comparative example) | S-E | +0.07 | 91 | +0.21 | 78 |
| 314 (Comparative example) | S-F | +0.23 | 90 | +0.42 | 65 |
| 315 (Comparative example) | S-G | +0.07 | 86 | +0.21 | 72 |
| 316 (Comparative example) | S-H | +0.05 | 84 | +0.12 | 66 |

EXAMPLE 7

Preparation of sample 401

Sample 401, a multi-layered color light-sensitive material consisting of layers respectively having the following compositions was prepared on a cellulose triacetate film support which had provided thereon with an undercoat.

Composition of light-sensitive layer

Coated amounts are represented by g-silver/m$^2$ for silver halide and colloidal silver, by g/m$^2$ for the coupler additives and gelatin, and by mole number per mole of silver halide in the same layer for the sensitizing dye.

| | |
|---|---|
| The 1st layer (Antihalation layer) | |
| Black colloidal silver | 0.2 |
| Gelatin | 1.3 |
| Colored coupler Cpd-7 | 0.06 |
| UV absorbent UV-1 | 0.1 |
| UV absorbent UV-2 | 0.2 |
| Dispersion oil Oil-1 | 0.01 |
| Dispersion oil Oil-2 | 0.01 |
| The 2nd layer (Intermediate layer) | |
| Fine grain silver bromide (Average grain size 0.07 micron) | 0.15 |
| Gelatin | 1.0 |

-continued

| | |
|---|---|
| Colored coupler Cpd-27 | 0.02 |
| Dispersion oil Oil-1 | 0.1 |
| The 3rd layer (The first red-sensitive emulsion layer) | |
| Silver iodobromide emulsion 4 mol % silver iodide, Variation coefficient of grain size ($S/\bar{r}$) = 0.12, Average grain size ($\bar{r}$) = 0.7 micron 0.6 (g/m$^2$) (The above expression is hereinafter simply expressed as 4 mole $I^-$, $S/\bar{r}$) = 0.12 0.7 micron 0.6) | |
| Silver iodobromide emulsion 3 mole $I^-$, $S/\bar{r}$ = 0.11, 0.3$\mu$ | 0.3 |
| Gelatin | 0.6 |
| Sensitizing dye I | $4 \times 10^{-4}$ |
| Sensitizing dye II | $5 \times 10^{-5}$ |
| Cpd-9 | 0.010 |
| Cpd-10 | 0.010 |
| Cpd-21 | 0.50 |
| Cpd-27 | 0.04 |
| Oil-1 | 0.15 |
| Oil-3 | 0.02 |
| The 4th layer (The second red-sensitive emulsion layer) | |
| Silver iodobromide emulsion 6 mole $I^-$, $S/\bar{r}$ = 0.15, 1.0 micron | 0.7 |
| Gelatin | 1.0 |
| Sensitizing dye I | $4 \times 10^{-4}$ |
| Sensitizing dye II | $5 \times 10^{-5}$ |
| Cpd-24 | 0.1 |
| Cpd-28 | 0.1 |
| Oil-1 | 0.01 |
| Oil-3 | 0.05 |
| The 5th layer (Intermediate layer) | |
| Gelatin | 0.5 |
| Cpd-6 | 0.10 |
| Oil-1 | 0.05 |
| The 6th layer (The first green-sensitive emulsion layer) | |
| Silver iodobromide emulsion 4 mole $I^-$, $S/\bar{r}$ = 0.11, 0.6 micron | 0.35 |
| Silver iodobromide emulsion 3 mole $I^-$, $S/\bar{r}$ = 0.15 0.3 micron | 0.20 |
| Gelatin | 1.0 |
| Sensitizing dye IV | $1 \times 10^{-4}$ |
| Sensitizing dye V | $5 \times 10^{-4}$ |
| Cpd-5 | 0.3 |
| Cpd-7 | 0.07 |
| Cpd-13 | 0.03 |
| Oil-1 | 0.3 |
| Oil-4 | 0.1 |
| The 7th layer (The 2nd green-sensitive emulsion layer) | |
| Silver iodobromide emulsion 6 mole $I^-$, $S/\bar{r}$ = 0.18, 0.8 micron | 0.8 |
| Gelatin | 0.5 |
| Sensitizing dye IV | $1 \times 10^{-4}$ |
| Sensitizing dye V | $5 \times 10^{-4}$ |
| Cpd-5 | 0.1 |
| Cpd-15 | 0.1 |
| Cpd-8 | 0.01 |
| Cpd-7 | 0.02 |
| Oil-1 | 0.2 |
| Oil-4 | 0.05 |

-continued

| | |
|---|---|
| The 8th layer (Intermediate layer) | |
| Gelatin | 0.5 |
| Cpd-6 | 0.05 |
| Oil-1 | 0.03 |
| The 9th layer (Donor layer of interlayer effect) | |
| Silver iodobromide emulsion 2 mole % silver iodide, Aspect ratio (A/R) = 6.0, Tabular grains having an average size of 1.0 micron | 0.35 g/m$^2$ |
| The above expression is hereinafter simply expressed as 2 mole $I^-$, A/R = 6.0 1.0 micron | 0.35 |
| Silver iodobromide emulsion 2 mole $I^-$, A/R = 6.5 0.5 micron | 0.20 |
| Gelatin | 0.7 |
| Sensitizing dye III | $8 \times 10^{-4}$ |
| Cpd-3 | 0.18 |
| Cpd-4 | 0.05 |
| Cpd-5 | 0.13 |
| Oil-1 | 0.20 |
| The 10th layer (Yellow filter layer) | |
| Gelatin | 0.5 |
| Cpd-2 | 0.25 |
| Cpd-6 | 0.10 |
| The 11th layer (The first blue-sensitive emulsion layer) | |
| Silver iodobromide emulsion 3 mole $I^-$, A/R = 7.5, 1.0 micron | 0.3 |
| Silver iodobromide emulsion 3 mole $I^-$, A/R = 7.5, 0.5 micron | 0.15 |
| Gelatin | 1.0 |
| Sensitizing dye VI | $2 \times 10^{-4}$ |
| Cpd-1 | 0.05 |
| Cpd-8 | 0.10 |
| Cpd-29 | 0.80 |
| Oil-1 | 0.20 |
| The 12th layer (The second blue-sensitive emulsion layer) | |
| Silver iodobromide emulsion 10 mole $I^-$, $S/\bar{r}$ = 0.11, 1.2 micron | 0.5 |
| Gelatin | 0.5 |
| Sensitizing dye VI | $1 \times 10^{-4}$ |
| Cpd-29 | 0.20 |
| Cpd-3 | 0.02 |
| Oil-1 | 0.10 |
| The 13th layer (The first protective layer) | |
| Gelatin | 0.8 |
| UV-1 0.1 | 0.1 |
| UV-2 0.2 | 0.2 |
| Oil-1 | 0.01 |
| Oil-2 | 0.01 |
| The 14th layer (The second protective layer) | |
| Fine grain silver bromide emulsion 2 mole $I^-$, $S/\bar{r}$ = 0.2, 0.07 micron | 0.5 |
| Gelatin | |
| Polymethyl methacrylate grains having a diameter of 1.5 micron | 0.2 |
| Hardening agent H-1 | 0.4 |
| Formaldehyde scavenger S-1 | 0.5 |
| Formaldehyde scavenger S-2 | 0.5 |

Besides the above components, Cpd-26 which is a stabilizer of the emulsions and a surfactant were added to each layer as coating aids.

Cpd-1
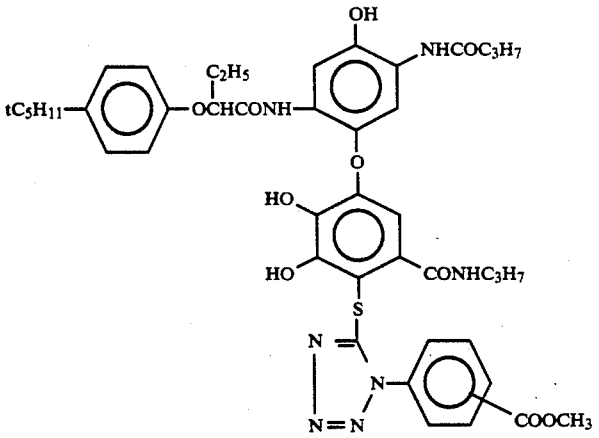
Cpd-2
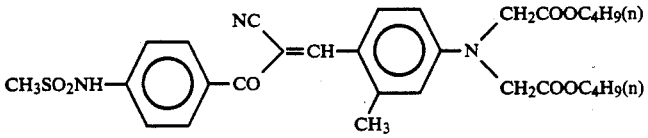
Cpd-3
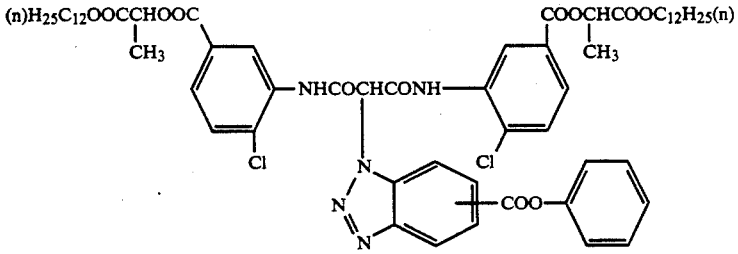
Cpd-4
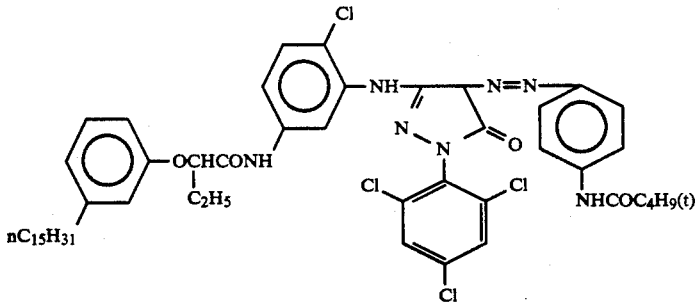
Cpd-5
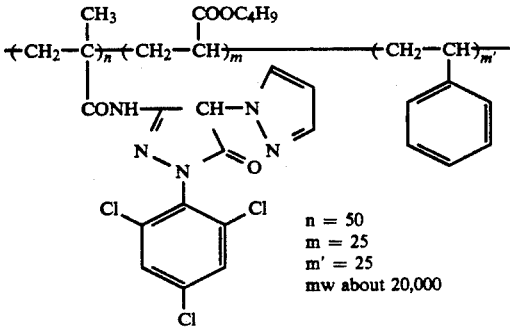

-continued
Cpd-6
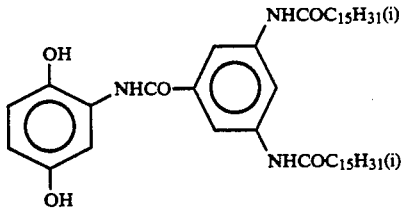
Cpd-7
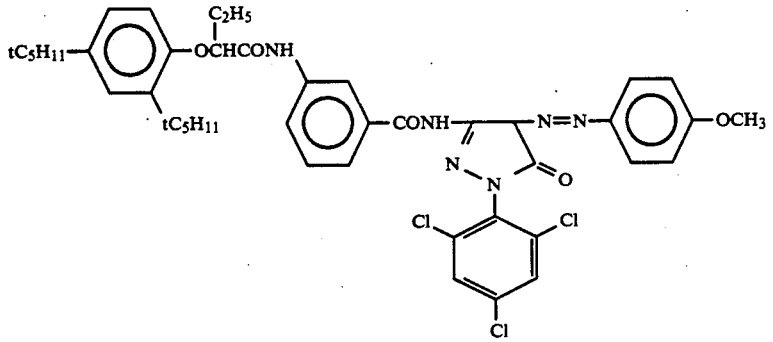
Cpd-8
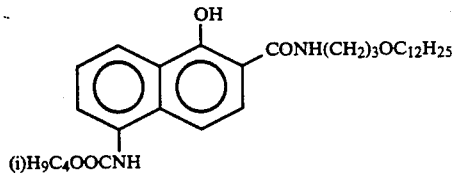
Cpd-9
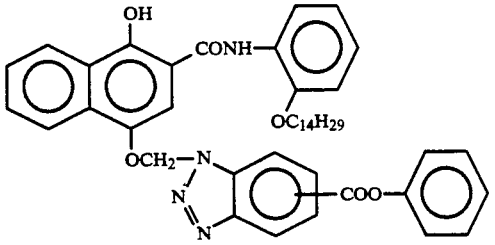
Cpd-10
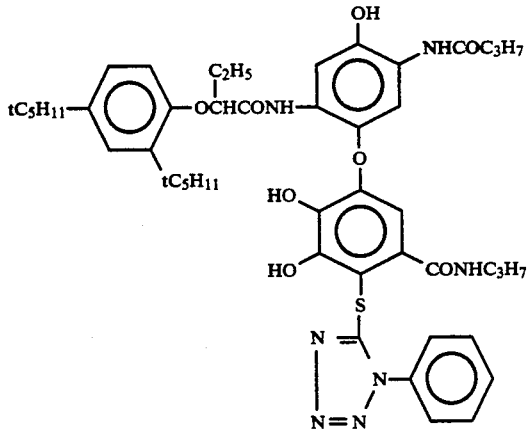

-continued
Cpd-11
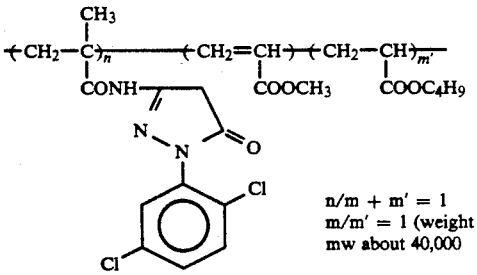
n/m + m' = 1
m/m' = 1 (weight ratio)
mw about 40,000
Cpd-12
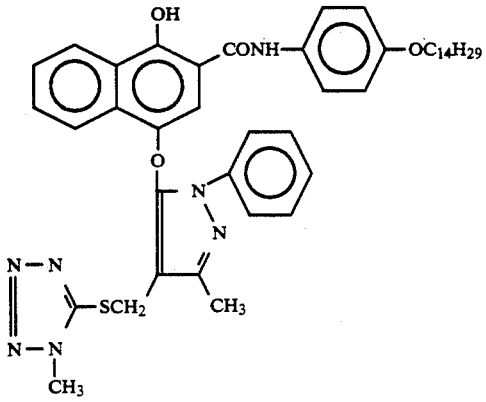
Cpd-13
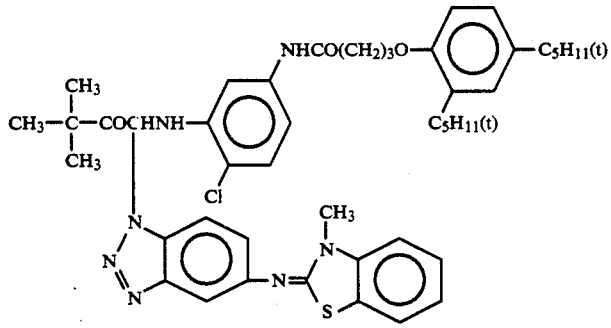
Cpd-14
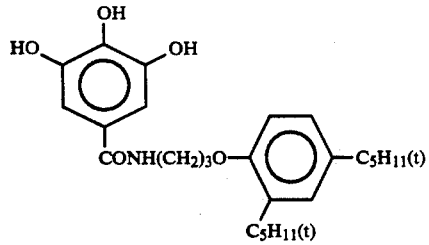
Cpd-15
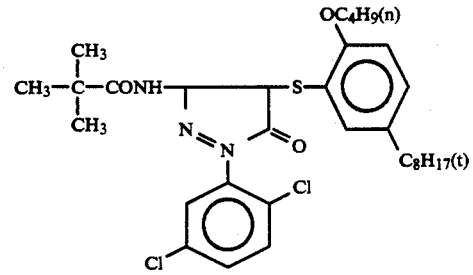

-continued
Cpd-16
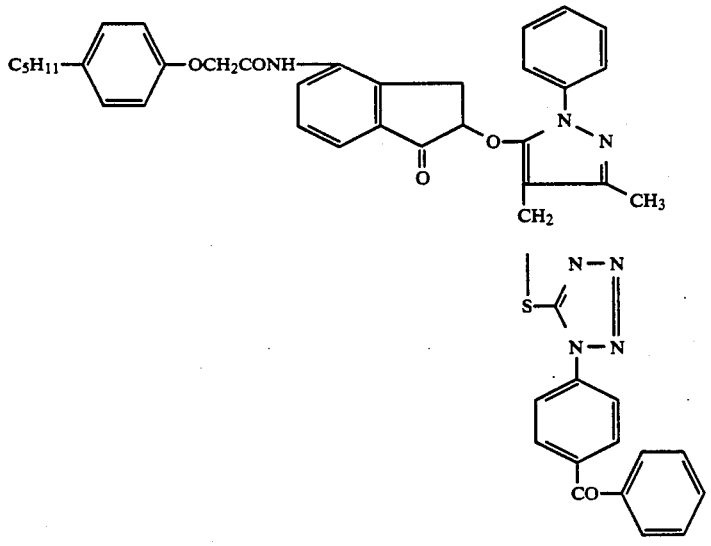
Cpd-17
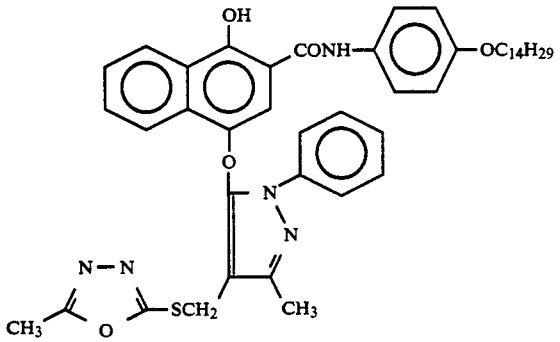
Cpd-18
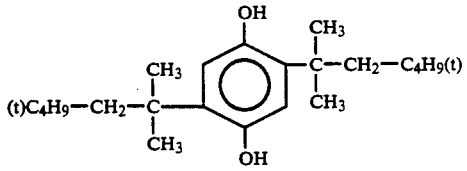
Cpd-19
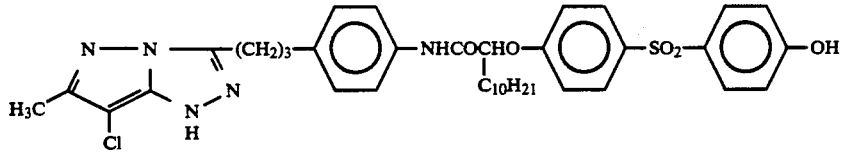
Cpd-20
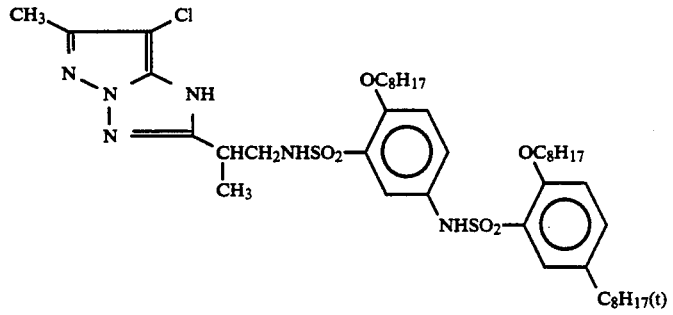

-continued
Cpd-21
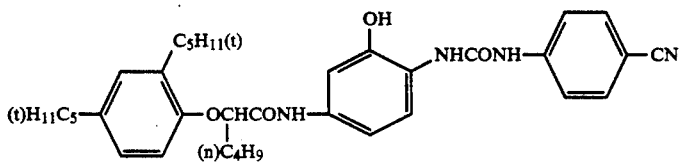
Cpd-22
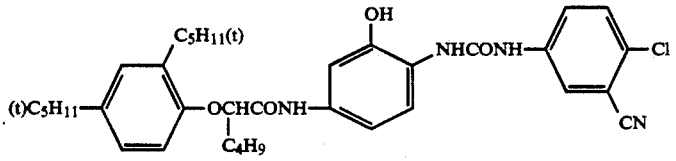
Cpd-23
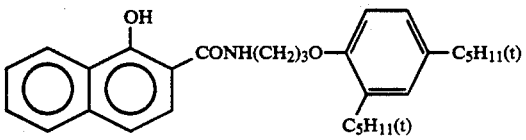
Cpd-24
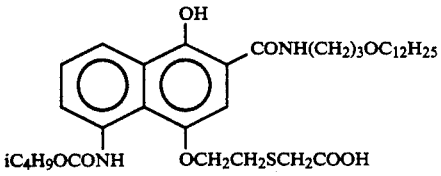
Cpd-25
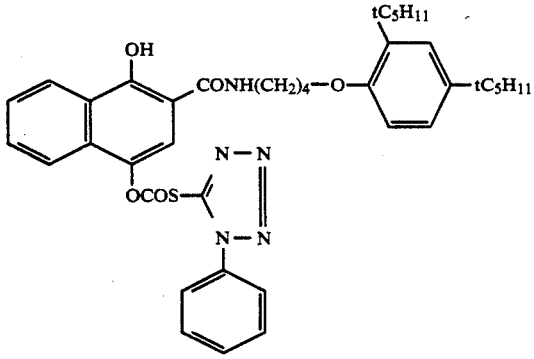
Cpd-26
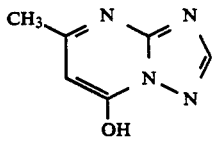
Cpd-27
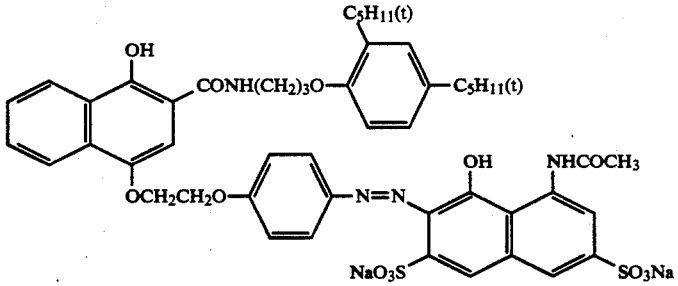
Cpd-28
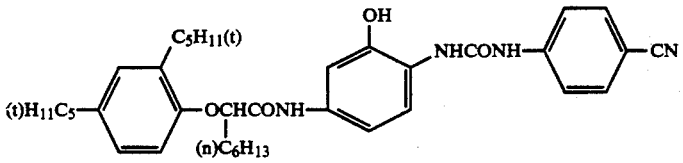

-continued
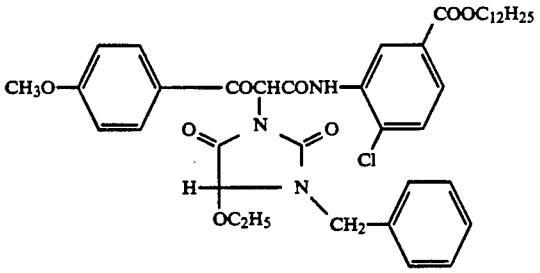
Cpd-29
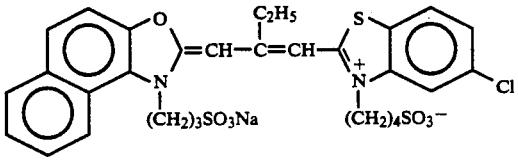
Sensitizing dye I
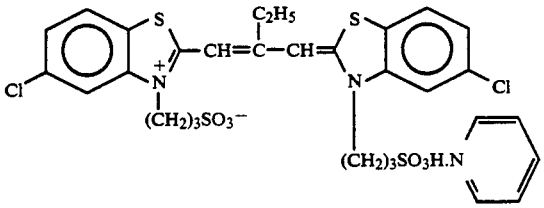
Sensitizing dye II
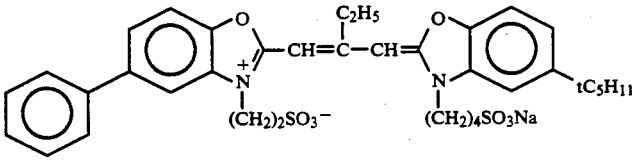
Sensitizing dye III
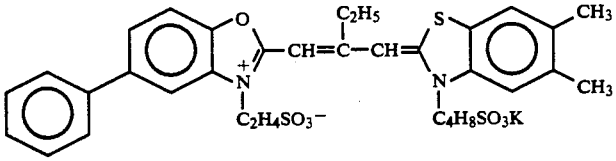
Sensitizing dye IV
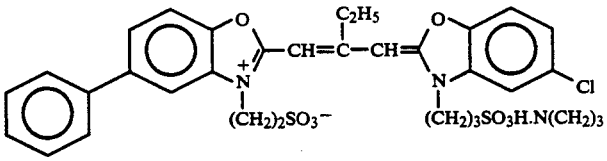
Sensitizing dye V
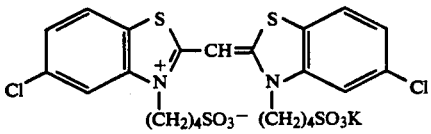
Sensitizing dye VI
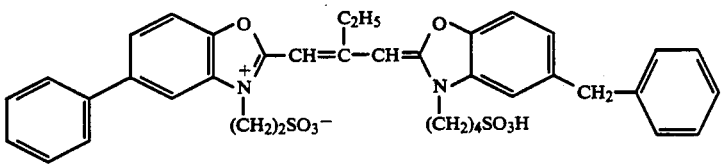
Sensitizing dye S-A -continued
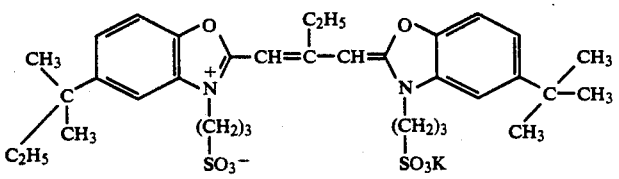
Sensitizing dye S-B
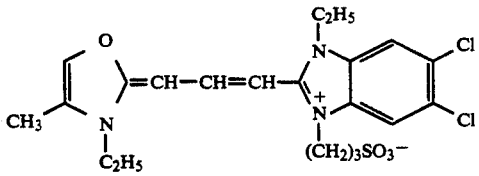
Sensitizing dye S-C
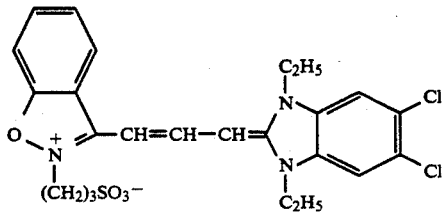
Sensitizing dye S-D
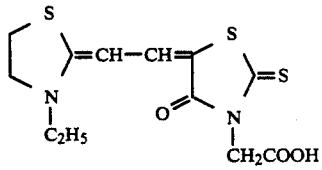
Sensitizing dye S-E
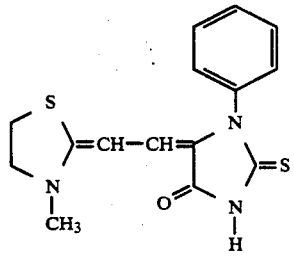
Sensitizing dye S-F
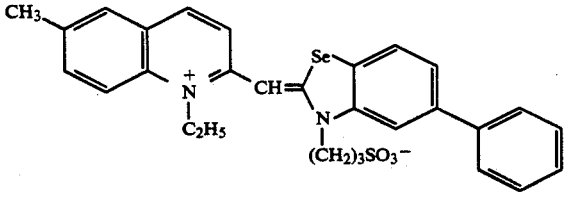
Sensitizing dye S-G
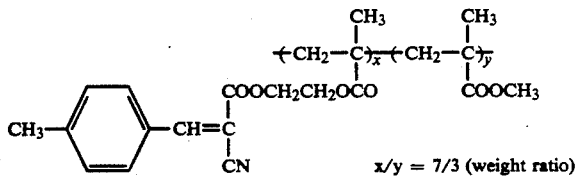
x/y = 7/3 (weight ratio)
UV-1
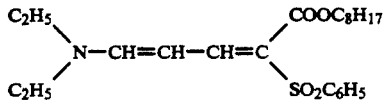
UV-2
Tricresyl phosphate — Oil-1
Dibutyl phthalate — Oil-2
Bis(2-ethylhexyl) phthalate — Oil-3

-continued

Oil-4

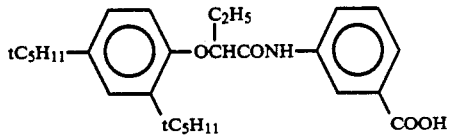

H-1

$CH_2{=}CH{-}SO_2{-}CH_2{-}CONH{-}CH_2$
$CH_2{=}CH{-}SO_2{-}CH_2{-}CONH{-}CH_2$

S-1

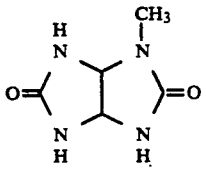

Samples 402 to 408 were obtained each using the same composition as that of sample 401 except that changes in composition exhibited in Table 6 were made.

These photographic element were subjected to exposure to light with an exposure amount of 25 CMS using a tungsten light source whose color temperature had been adjusted to 4800° K. with a filter, and subjected to developing process at 38° C. according to the following process steps.

| | |
|---|---|
| Color development | 3 minutes 15 seconds |
| Bleaching | 6 minutes 30 seconds |
| Water washing | 2 minutes 10 seconds |
| Fixing | 4 minutes 20 seconds |
| Water washing | 3 minutes 15 seconds |
| Stabilization | 1 minute 5 seconds |

Compositions of processing solutions used in respective steps are as follows.

| | |
|---|---|
| Color developing solution | |
| Diethylenetriaminepentaacetic acid | 1.0 g |
| 1-Hydroxyethylidene-1,1-diphosphonic acid | 2.0 g |
| Sodium sulfite | 4.0 g |
| Potassium carbonate | 30.0 g |
| Potassium bromide | 1.4 g |
| Potassium iodide | 1.3 mg |
| Hydroxylamine sulfate | 2.4 g |
| 4-(N-Ethyl-N-β-hydroxyethylamino)-2-methylamiline sulfate | 4.5 g |
| Water to | 1.0 l |
| | pH 10.0 |
| Bleaching solution | |
| Ferric ammonium ethylenediaminetetraacetate | 100.0 g |
| Disodium ethylenediaminetetraacetate | 10.0 g |
| Ammonium bromide | 150.0 g |
| Ammonium nitrate | 10.0 g |
| Water to | 1.0 l |
| | pH 6.0 |
| Fixing solution | |
| Disodium ethylenediaminetetraacetate | 1.0 g |
| Sodium sulfite | 4.0 g |
| Aqueous 70% ammonium thiosulfate solution | 175.0 ml |
| Sodium bisulfite | 4.6 g |
| Water to | 1.0 l |
| | pH 6.6 |
| Stabilizing solution | |
| Formalin (40%) | 2.0 ml |
| Polyoxyethylene-p-monononylphenyl ether (Average polymerization degree 10) | 0.3 g |
| Water to | 1.0 l |

Fog value and sensitivity value of each sample in fresh performance (just after preparation of the sample) were determined using fog value and sensitivity value of the green-sensitive layer of sample 401 in fresh performance as standards, and are shown in Table 6. Further, samples 401 to 408 were preserved for 3 days at 50° C. and 80% RH, and similarly exposed to light and developed, and fog and sensitivity values thereof were determined. The results are also shown in Table 6.

TABLE 6

| Sample No. | The 9th layer sensitizing dye Kind | Amount (mole/mole Ag) | Fresh performance Fog | Relative sensitivity | After preservation for 3 days at 50° C. and 80% RH Fog | Relative sensitivity |
|---|---|---|---|---|---|---|
| 401 (Present invention) | III | $8 \times 10^{-4}$ | ±0 (Standard of fog) | 100 (Standard of sensitivity) | +0.01 | 96 |
| 402 (Present invention) | S-A | " | −0.01 | 98 | +0.02 | 94 |
| 403 (Present invention) | S-B | " | −0.02 | 99 | +0.01 | 97 |
| 404 (Comparative example) | S-C | " | +0.09 | 102 | +0.23 | 77 |
| 405 (Comparative example) | S-D | " | +0.05 | 88 | +0.09 | 69 |
| 406 | S-E | " | +0.12 | 97 | +0.41 | 72 |

TABLE 6-continued

| Sample No. | The 9th layer sensitizing dye Kind | Amount (mole/mole Ag) | Fresh performance Fog | Relative sensitivity | After preservation for 3 days at 50° C. and 80% RH Fog | Relative sensitivity |
|---|---|---|---|---|---|---|
| (Comparative example) 407 (Comparative example) | S-F | " | +0.05 | 91 | +0.07 | 71 |
| 408 (Comparative example) | S-G | " | +0.03 | 89 | +0.07 | 70 |

As is seen from the above description, the use of an oxazole type dye represented by the general formula (I) makes it possible to improve stability during preservation which has been very low in usual sensitizing dyes each having maximum value of spectral sensitivity in a wavelength of 520 nm or more and less than 545 nm.

What is claimed is:

1. A silver halide photographic emulsion which has a maximum value of spectral sensitivity at a wavelength ranging from 520 nm to 545 nm, and which contains at least one compound represented by the following general formula (I):

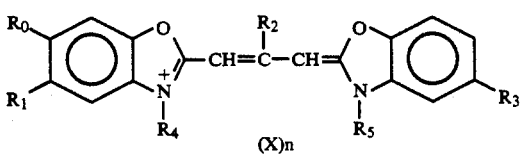

(I)

wherein $R_0$ is a hydrogen atom and $R_1$ is a phenyl group; $R_2$ represents a hydrogen atom, an unsubstituted or substituted alkyl group, or an unsubstituted or substituted aryl group; $R_3$ represents an unsubstituted or substituted alkyl group having two or more carbon atoms, an unsubstituted or substituted aryl group, an unsubstituted or substituted aryloxy group, an unsubstituted or substituted acyl group having three or more carbon atoms, an unsubstituted or substituted acyloxy group having three or more carbon atoms, an unsubstituted or substituted alkoxycarbonyl having 4 or more carbon atoms, or an unsubstituted or substituted acylamino group having three or more carbon atoms, and furthermore $R_3$ is a substituent having such L and B that S value is 544 or less in the equation of $S=3.536L-2.661B+535.4$ wherein L represents a parameter of STERIMOL, and B represents the smaller value among $B_1+B_4$ and $B_2+B_3$ which are parameters of STERIMOL, provided that $R_0$ and $R_3$, or $R_1$ and $R_3$ do not represent unsubstituted or substituted aryl groups at the same time; $R_4$ and $R_5$ may be the same or different and represent unsubstituted or substituted alkyl groups; X represents a counter anion; and n is 0 or 1, and when an inner salt is formed, n is 0.

2. The silver halide photographic emulsion of claim 1, wherein in the definition of $R_2$, the unsubstituted or substituted alkyl group is an unsubstituted or substituted alkyl group having 4 or less carbon atoms, or an aralkyl group having 10 or less carbon atoms; and the unsubstituted or substituted aryl group is one having 10 or less carbon atoms.

3. The silver halide photographic emulsion of claim 2, wherein in the definition of $R_2$, the unsubstituted or substituted alkyl group is a methyl group, an ethyl group, a propyl group, a butyl group, a benzyl group, a phenethyl group or a 3-phenylpropyl group; and the unsubstituted or substituted aryl group is a phenyl group or a p-tolyl group.

4. The silver halide photographic emulsion of claim 1, wherein $R_3$ is an ethyl group, a n-propyl group, an isopropyl group, a t-butyl group, an isopentyl group, a t-pentyl group, a 3,3-dimethylbutyl group, a cyclohexyl group, a t-octyl group, a benzyl group, a phenethyl group, or a t-butylcarbonyloxy group.

5. The silver halide photographic emulsion of claim 1, wherein the unsubstituted or substituted alkyl groups in the definition of $R_4$ and $R_5$ are unsubstituted or substituted alkyl groups having 8 or less carbon atoms, or unsubstituted or substituted aralkyl groups having 10 or less carbon atoms.

6. The silver halide photographic emulsion of claim 5, wherein the unsubstituted or substituted alkyl groups in the definition of $R_4$ and $R_5$ are methyl groups, ethyl groups, propyl groups, vinylmethyl groups, butyl groups, pentyl groups, hexyl groups, heptyl groups, octyl groups, benzyl groups, phenethyl groups, or 3-phenylpropyl groups.

7. The silver halide photographic emulsion of claim 1, wherein each substituent of the substituted alkyl groups in the definition of $R_4$ and $R_5$ is a hydroxyl group, a carboxyl group, a sulfo group, a cyano group, a halogen atom, an unsubstituted or substituted alkoxycarbonyl group having 8 or less carbon atoms, an unsubstituted or substituted alkoxy group having 8 or less carbon atoms, an unsubstituted or substituted aryloxy group having 8 or less carbon atoms, an unsubstituted or substituted acyloxy group having 8 or less carbon atoms, an unsubstituted or substituted acyl group having 8 or less carbon atoms, an unsubstituted or substituted carbamoyl group having 6 or less carbon atoms, an unsubstituted or substituted sulfamoyl group having 6 or less carbon atoms, or an unsubstituted or substituted aryl group having 10 or less carbon atoms.

8. The silver halide photographic emulsion of claim 1, wherein each substituent of the substituted alkyl groups in the definition of $R_4$ and $R_5$ is a hydroxyl group, a carboxyl group, a sulfo group, a cyano group, a halogen atom, a methoxycarbonyl group, an ethoxycarbonyl group, a benzyloxycarbonyl group, a methoxy group, an ethoxy group, a butyloxy group, a benzyloxy group, a phenethyloxy group, a phenoxy group, p-tolyloxy group, an acetyloxy group, a propionyloxy group, a benzoyloxy group, an acetyl group, a propionyl group, a benzoyl group, a 4-fluorobenzoyl group, a carbamoyl group, an N,N-dimethylcarbamoyl group, a morpholinocarbonyl group, a piperidinocarbonyl group, a sulfamoyl group, an N,N-dimethylsulfamoyl group, a morpholinosulfamoyl group, a piperidinosulfamoyl group, a phenyl group, a p-fluorophenyl group, a p-hydroxyphenyl group, a p-carboxyphenyl group, or a p-sulfophenyl group.

9. The silver halide photographic emulsion of claim 1, wherein a compound represented by the general formula (I) is contained in an amount of $1\times10^{-6}$ to $5\times10^{-3}$ mole per mole of the silver halide.

10. The silver halide photographic emulsion of claim 1, wherein the silver halide is silver bromide, silver iodobromide, silver iodochlorobromide, silver chlorobromide or silver chloride.

11. The silver halide photographic emulsion of claim 1, wherein grain size of the silver halide is 0.1 to 10 microns.

12. The silver halide photographic emulsion of claim 1, wherein the silver halide grains are tabular grains having an aspect ratio of 5 to 100.

13. The silver halide photographic emulsion of claim 1, wherein crystals of the silver halide is composed of a uniform structure, a halogen composition heterogenous between inside and outside, or a layer structure.

14. The silver halide photographic emulsion of claim 13, wherein the silver halide grains respectively have substantially two distinct layer structures composed of a core part of a higher iodine content and a shell part of a lower iodine content.

15. The silver halide photographic emulsion of claim 14, wherein silver halide other than silver iodide in the core part is silver chlorobromide or silver bromide, and silver halide other than silver iodide in the shell part is silver chloride, silver chlorobromide or silver bromide.

16. The silver halide photographic emulsion of claim 14, wherein the shell thickness is 0.1 micron or more in a largesized grain of 1.0 micron or more, and 0.05 micron or more in a small-sized grain less than 1.0 micron.

17. The silver halide photographic emulsion of claim 14, wherein the silver amount ratio of the core part to the shell part falls within a range of 1/5 to 5.

18. The silver halide photographic emulsion of claim 1, which further contains a yellow dye-forming coupler, a magenta dye-forming coupler and a cyan dye-forming coupler.

* * * * *